United States Patent [19]

Weinerman et al.

[11] Patent Number: 4,841,755

[45] Date of Patent: Jun. 27, 1989

[54] LATCH AND LOCK ASSEMBLIES WITH SPRING-BIASED SLIDE BOLTS

[75] Inventors: Lee S. Weinerman, Medina; Steven A. Mayo, Akron; Joel T. Vargus, Middleburg Heights; Frank R. Albris, Parma, all of Ohio; Richard H. Russell, Farmington, Conn.; Thomas V. McLinden, Oxford, Conn.; Richard M. O'Grady, Southington, Conn.; Timothy H. Wentzell, South Windsor, Conn.

[73] Assignee: The Eastern Company, Cleveland, Ohio

[21] Appl. No.: 72,177

[22] Filed: Jul. 10, 1987

Related U.S. Application Data

[63] Continuation-in-part of Ser. No. 859,194, Apr. 28, 1986, Pat. No. 4,683,736, which is a continuation-in-part of Ser. No. 601,648, Apr. 18, 1984, abandoned.

[51] Int. Cl.[4] ..... E05B 13/10

[52] U.S. Cl. ..... 70/208; 70/210; 70/83; 292/227; 292/DIG. 31

[58] Field of Search ..... 70/81, 83, 84, 208, 70/431, 451, 466, 483–485, 489; 292/198, 210, 224, 227, 240–242, 228, 164, DIG. 31, DIG. 37, DIG. 63

[56] References Cited

U.S. PATENT DOCUMENTS

| | | | |
|---|---|---|---|
| D. 196,424 | 10/1963 | Are | D10/8 |
| D. 210,152 | 2/1968 | Pastva | D50/5 |
| D. 210,153 | 2/1968 | Pastva | D50/5 |
| D. 218,672 | 9/1970 | Lauper | D8/109 |
| D. 230,132 | 1/1974 | Pastva | D8/109 |
| D. 265,965 | 8/1982 | Davis et al. | D8/302 |
| D. 270,328 | 8/1983 | Davis et al. | D8/302 |
| D. 271,562 | 11/1983 | Weinerman | D8/338 |
| D. 292,482 | 10/1987 | Weinerman et al. | D8/302 |
| 1,995,106 | 3/1935 | Roedding | 292/227 X |
| 2,266,119 | 12/1941 | Jacobi | 292/227 |
| 2,317,700 | 4/1943 | Thompson | 292/254 |
| 2,387,187 | 10/1945 | Smith | 70/97 |
| 2,594,940 | 4/1952 | Levine | 70/66 |
| 2,637,585 | 5/1953 | Troche et al. | 292/336.3 |
| 2,642,300 | 6/1953 | Pelcin | 292/173 |
| 2,649,322 | 8/1953 | Mack | 292/173 |
| 2,668,076 | 2/1954 | Troche et al. | 292/336.3 |
| 2,703,431 | 3/1955 | Tatom | 292/DIG. 31 X |
| 2,721,751 | 10/1955 | Holritz | 292/169 |
| 2,735,706 | 2/1956 | Pelcin | 292/34 |
| 2,746,784 | 3/1956 | Holritz | 292/175 |
| 2,763,503 | 9/1956 | Tasch et al. | 292/173 |
| 2,784,993 | 3/1957 | Collar | 292/223 |
| 2,840,407 | 6/1958 | Sellon, Jr. | 292/169 |
| 2,871,048 | 1/1959 | Balogh | 292/173 |
| 2,900,204 | 8/1959 | Pelcin | 292/173 |
| 2,916,905 | 12/1959 | Podlesak | 70/150 |
| 2,952,150 | 9/1960 | Matzkin et al. | 70/451 |
| 2,962,320 | 11/1960 | Gilbert | 70/451 X |

(List continued on next page.)

OTHER PUBLICATIONS

Southco Inc., *Southco Fasteners Handbook* 37, Concordville, PA 19331, date unknown.

Eberhard Manufacturing Co., *Handbook of Latches, Locks, Hinges, Handles, and Related Hardware. No.* 103, Cleveland, OH 44136, 1985.

Adams Rite Manufacturing Co., *Hardware For Glass Doors That Swing or Slide,* City of Industry, CA 91749, Jan, 1988.

*Primary Examiner*—Gary L. Smith
*Assistant Examiner*—Suzanne L. Dino
*Attorney, Agent, or Firm*—David A. Burge

[57] ABSTRACT

Flush mountable latches and locks for industrial cabinets, tool carts, electrical equipment enclosures and the like utilize versatile housings of novel configuration together with a variety of types of handles that are movable relative to the housing to effect unlatching movements of spring-projected slide bolts. Locking mechanisms are mountable on the housings to selectively permit and prevent unlatching movements of the latch bolts. The resulting arrangement provides sturdy latch and lock assemblies that employs a small number of relatively movable parts that can be assembled and serviced with ease.

54 Claims, 19 Drawing Sheets

U.S. PATENT DOCUMENTS

| | | | |
|---|---|---|---|
| 2,987,908 | 6/1961 | Pelcin | 70/146 |
| 3,044,287 | 7/1962 | Pelcin | 70/99 |
| 3,044,814 | 7/1962 | Pelcin | 292/126 |
| 3,055,204 | 9/1962 | Pelcin | 70/153 |
| 3,081,617 | 3/1963 | McKay | 70/153 |
| 3,111,833 | 11/1963 | Dettmer | 70/208 X |
| 3,209,563 | 10/1965 | Pelcin | 70/146 |
| 3,209,564 | 10/1965 | Pelcin | 70/148 |
| 3,240,523 | 3/1966 | Heimann | 292/241 X |
| 3,338,610 | 8/1967 | Pelcin et al. | 292/126 |
| 3,357,734 | 12/1967 | Pastva, Jr. | 292/165 |
| 3,371,511 | 3/1968 | Atkinson | 70/71 |
| 3,389,932 | 6/1968 | Pastva, Jr. | 292/173 |
| 3,449,005 | 6/1969 | Pastva, Jr. | 292/173 |
| 3,495,862 | 2/1970 | McClintock | 292/173 |
| 3,508,778 | 4/1970 | Legge et al. | 292/DIG. 31 X |
| 3,550,412 | 12/1970 | Pitel et al. | 70/208 X |
| 3,558,167 | 1/1971 | Atkinson | 292/228 |
| 3,576,118 | 4/1971 | Doerrfeld | 70/146 |
| 3,659,445 | 5/1972 | Eads et al. | 70/451 |
| 3,668,907 | 6/1972 | Pastva, Jr. | 70/153 |
| 3,707,862 | 1/1973 | Pastva, Jr. | 70/150 |
| 3,743,336 | 7/1973 | Andrews | 292/173 |
| 3,758,140 | 9/1973 | Prete, Jr. | 292/223 |
| 3,782,141 | 1/1974 | Doerrfeld | 70/146 |
| 3,795,416 | 3/1974 | Hehl et al. | 292/336.3 |
| 3,841,674 | 10/1974 | Bisbing et al. | 292/175 |
| 3,850,464 | 11/1974 | Bisbing et al. | 292/175 |
| 3,857,594 | 12/1974 | Pastva, Jr. | 292/27 |
| 3,871,198 | 3/1975 | Miller | 70/146 |
| 4,021,073 | 5/1977 | Manning | 292/228 X |
| 4,038,718 | 8/1977 | Reilhac et al. | 16/110 |
| 4,116,027 | 9/1978 | Tannery | 70/472 |
| 4,131,002 | 12/1978 | Gianelo | 70/84 |
| 4,132,092 | 1/1979 | Steinbach | 70/208 |
| 4,134,281 | 1/1979 | Pelcin | 70/208 |
| 4,138,869 | 2/1979 | Pelcin | 70/151 |
| 4,170,119 | 10/1979 | Kalis, Jr. | 70/221 |
| 4,177,656 | 12/1979 | Davis | 70/84 |
| 4,231,597 | 11/1980 | Pelcin | 292/164 |
| 4,309,884 | 1/1982 | Davis | 292/DIG. 31 X |
| 4,312,202 | 1/1982 | Pastva, Jr. et al. | 70/472 |
| 4,312,203 | 1/1982 | Davis | 70/472 |
| 4,312,204 | 1/1982 | Davis | 70/472 |
| 4,312,205 | 1/1982 | Reed et al. | 70/472 |
| 4,320,642 | 3/1982 | Pastva, Jr. | 70/472 |
| 4,321,812 | 3/1982 | Pelcin | 70/472 |
| 4,335,595 | 6/1982 | Swan et al. | 70/149 |
| 4,370,874 | 2/1983 | Munn | 70/204 |
| 4,413,849 | 11/1983 | Davis et al. | 292/229 |
| 4,420,954 | 12/1983 | Hieronymi et al. | 70/150 |
| 4,438,964 | 3/1984 | Peters | 292/216 |
| 4,465,328 | 8/1984 | Tihanyi et al. | 312/215 |
| 4,489,904 | 12/1984 | Soederberg | 292/DIG. 31 X |
| 4,492,394 | 1/1985 | Dignan | 292/64 |
| 4,498,319 | 2/1985 | Balducci et al. | 70/489 X |
| 4,510,779 | 4/1985 | Ahad | 70/208 |
| 4,578,968 | 4/1986 | Messier, Jr. | 70/208 |
| 4,671,547 | 6/1987 | Weinerman et al. | 292/197 |
| 4,676,081 | 6/1987 | Craig | 292/DIG. 31 X |
| 4,679,835 | 7/1987 | Weinerman et al. | 292/197 |
| 4,683,736 | 8/1987 | Weinerman et al. | 70/208 |
| 4,693,503 | 9/1987 | Bisbing | 292/DIG. 31 X |
| 4,706,478 | 11/1987 | Swan et al. | 70/208 |
| 4,707,006 | 11/1987 | Garg et al. | 292/DIG. 31 X |

LATCH AND LOCK ASSEMBLIES WITH SPRING-BIASED SLIDE BOLTS

The present application is a continuation-in-part of a co-pending application entitled CABINET LOCK WITH RECESSED HANDLE, Ser. No. 859,194 filed Apr. 28, 1986 by Lee S. Weinerman et al as a continuation-in-part of application Ser. No. 601,648 filed Apr. 18, 1984 (now abandoned), which applications are referred to hereinafter as the "Parent Cases," the disclosures of which are incorporated herein by reference Application Ser. No. 859,194 issued Aug. 4, 1987 as U.S. Pat. No. 4,683,736.

CROSS-REFERENCE TO RELATED APPLICATIONS

Reference is made to the following related, concurrently-filed applications, the disclosures of which are incorporated herein by reference:

LATCH AND LOCK HOUSINGS, HANDLES AND MOUNTING BRACKETS, Ser. No. 072,176, filed July 10, 1987 by Lee S. Weinerman, Steven A. Mayo, Joel T. Vargus, Frank R. Albris, Richard H. Russell, Thomas V. McLinden, Richard M. O'Grady and Timothy H. Wentzell, hereinafter referred to as the "Utility Case I;"

LATCH AND LOCK ASSEMBLIES WITH SPRING-BIASED PIVOT BOLTS, Ser. No. 072,174, filed July 10, 1987 by Lee S. Weinerman, Steven A. Mayo, Thomas V. McLinden and Timothy H. Wentzell, hereinafter referred to as the "Utility Case III;"

LATCH AND LOCK ASSEMBLIES WITH LIFT AND TURN HANDLES, Ser. No. 072,175, filed July 10, 1987 by Lee S. Weinerman, Frank R. Albris, Thomas V. McLinden and Timothy H. Wentzell, hereinafter referred to as the "Utility Case IV;"

LATCH AND LOCK ASSEMBLIES WITH EXPANSIBLE LATCH ELEMENTS, Ser. No. 072,250, filed July 10, 1987 by Lee S. Weinerman, Steven A. Mayo, Thomas V. McLinden and Timothy H. Wentzell, hereinafter referred to as the "Utility Case V;"

HOUSINGS FOR LATCHES AND LOCKS, Ser. No. 072,282, filed July 10, 1987 by Richard H. Russell, David W. Kaiser and Richard M. O'Grady, hereinafter referred to as the "Design Case I;"

COMBINED HOUSINGS AND HANDLES FOR LATCHES AND LOCKS, Ser. No. 072,283, filed July 10, 1987 by Richard H. Russell, David W. Kaiser and Richard M. O'Grady, hereinafter referred to as the "Design Case II;"

COMBINED HOUSINGS AND HANDLES FOR LATCHES AND LOCKS, Ser. No. 072,285, filed July 10, 1987 by Richard H. Russell and David W. Kaiser, hereinafter referred to as the "Design Case III;"

COMBINED HOUSINGS AND HANDLES FOR LATCHES AND LOCKS, Ser. No. 072,284, filed July 10, 1987 by Richard H. Russell and David W. Kaiser, hereinafter referred to as the "Design Case IV;"

COMBINED HOUSINGS AND HANDLES FOR LATCHES AND LOCKS, Ser. No. 072,276, filed July 10, 1987 by Richard H. Russell and David W. Kaiser, hereinafter referred to as the "Design Case V;"

COMBINED HOUSINGS AND HANDLES FOR LATCHES AND LOCKS, Ser. No. 072,573, filed July 10, 1987 by Richard H. Russell and David W. Kaiser, hereinafter referred to as the "Design Case VI;" COMBINED HOUSINGS AND HANDLES FOR LATCHES AND LOCKS, Ser. No. 072,277, filed July 10, 1987 by Richard H. Russell and David W. Kaiser, hereinafter referred to as the "Design Case VII;"

MOUNTING BRACKETS FOR LATCHES AND LOCKS, Ser. No. 072,278, filed July 10, 1987 by Richard H. Russell and Thomas V. McLinden, hereinafter referred to as the "Design Case VIII;"

MOUNTING BRACKETS FOR LATCHES AND LOCKS, Ser. No. 072,280, filed July 10, 1987 by Richard H. Russell and Thomas V. McLinden, hereinafter referred to as the "Design Case IX;"

STRIKERS FOR USE WITH LATCHES AND LOCKS, Ser. No. 072,279, filed July 10, 1987 by Lee S. Weinerman and Steven A. Mayo, hereinafter referred to as the "Design Case X;" and, STRIKERS FOR USE WITH LATCHES AND LOCKS, Ser. No. 072,281, filed July 10, 1987 by Lee S. Weinerman and Steven A. Mayo, hereinafter referred to as the "Design Case XI."

BACKGROUND OF THE INVENTION

1. Field of the Invention

The present invention relates generally to flush mounted latches and locks of the type used with closures for industrial cabinets, tool carts, electrical equipment enclosures and the like. More particularly, the present invention relates to novel and improved latches and locks that utilize a highly versatile housing together with other interactive components of novel form to provide desired types of latching and locking actions.

2. Prior Art

Flush mounted latches and locks including a body, a latch bolt movably carried on the body, and an operating handle that is nested by the body are well known. Normally the handle is in a flush or nested position when the bolt is in a latched position; and, unlatching movement of the bolt is effected by moving the handle to an operating position. Latches and locks of this type are well suited for use on industrial cabinets, tool carts, electrical equipment enclosures and the like.

Flush-mounted latches and locks having pan-shaped housings that nest paddle-shaped operating handles, and that have spring-projected slide bolts are disclosed in such U.S. Pats. Nos. as 4,335,595, 4,321,812, 4,320,642, 4,312,205, 4,312,204, 4,312,203, 4,312,202, 4,309,884, 4,231,597, 4,138,869, 3,707,862, 3,668,907, 3,449,005, 3,389,932, 3,357,734, 3,209,564, 3,209,563, 3,055,204, 2,987,908, 2,900,204 and 2,642,300, all of which are assigned to the Eastern Company, a corporation of Connecticut.

Flush mounted latches and locks having latch bolts of other than the spring-projected, slide-mounted type are disclosed in such U.S. Pats. Nos. as 4,413,849, 4,320,642, 4,312,203, 4,134,281, 3,857,594, 3,338,610, 3,044,814, 3,044,287 and 2,735,706, which are assigned to the Eastern Company.

A cabinet latch having a housing that is usable with a variety of pivotally mounted latch bolts, and with a variety of latching mechanisms is disclosed in U.S. Pat. No. 4,177,656, also assigned to the Eastern Company.

3. The Cross-Referenced Utility and Design Cases

The present invention, and the inventions described in the several referenced Utility and Design Cases, represent the work products of a long term and continuing development program.

The several functional features that form the subjects matter of the referenced Utility Cases, and the several appearance features that form the subjects matter of the referenced Design Cases, were developed by various co-workers, as is reflected in the listing of inventors in these cases. Many of the functional and appearance features that are claimed in separate ones of the referenced Utility and Design Cases were developed substantially concurrently.

If an invention feature that is disclosed in one of the referenced Utility and Design Cases constitutes a species of a development concept that is utilized in another of these related cases, it will be understood that care has been taken to present a generic claim in the case that describes the earliest development of a species that will support the generic claim. In this manner, a careful effort has been made to establish clear lines of demarcation among the claimed subjects matter of this and the several referenced Utility and Design Cases. No two of these cases include claims of identical scope.

4. The Referenced Parent Cases

The referenced Parent Cases discloses a simple means for retaining a key cylinder assembly in a lock housing. The lock housing has a generally cylindrical opening formed therethrough that extends along an axis for mounting a key cylinder assembly for rotation about the axis. Axially extending grooves are formed in an internal wall that defines the cylindrical opening. One of the grooves (referred to as an "installation groove") extends rearwardly and opens through such rear wall portions of the housing as surround the cylindrical opening. The grooves serve the function of cooperating with key operated tumblers of the key cylinder assembly that project radially from opposed sides of the key cylinder assembly to selectively permit and prevent rotation of the key cylinder assembly relative to the housing. The installation groove serves the function of permitting an offset projection that is carried on the back of the key cylinder assembly to be inserted completely through the cylindrical opening of the housing as the key cylinder assembly is installed in the cylindrical opening. Once the key cylinder assembly is installed, it is rotated to position the offset projection out of alignment with the installation groove so that the offset projection extends in overlying relationship with such rear wall portions of the housing as surround the cylindrical opening in which the key cylinder assembly is installed. By this arrangement, so long as the key cylinder is prevented from rotating relative to the housing to a position where the offset projection aligns with the installation groove, the offset projection serves to retain the key cylinder assembly in place on the housing.

As will be explained in greater detail, the type of housing features that are described above, and that are also disclosed in the referenced Parent Cases, are utilized in the preferred practice of the present invention. For this reason, the present application is being filed as a continuation-in-part case, with the benefits of the filing dates of the referenced Parent Cases being claimed.

SUMMARY OF THE INVENTION

The present invention provides novel and improved flush mountable latches and locks for industrial cabinets, tool carts, electrical equipment enclosures and the like, with the latches and locks utilizing a highly versatile housing together with other interactive components of novel form to provide desired types of latching and locking actions.

A latch or lock embodying the preferred practice of the present invention includes a one-piece housing on which are mounted other interactive components that provide a variety of desired features. As will become apparent from the description that follows, the versatile housing that is used with latches and locks that embody the preferred practice of the present invention provides a rigid, sturdy base structure for securely supporting a variety of latch and lock components. Latches and locks that embody the preferred practice of the present invention advantageously employ small numbers of relatively movable parts that can be assembled and serviced with ease.

The versatile housing on which other operating components are mounted preferably is formed from a suitable thermoplastics material such as a glass reinforced polycarbonate based polymer blend, which provides a dimensionally stable, impact resistant structure that is rigid, strong and can be readily machined as may be needed to provide mounting formations for movably mounting operating handles of a wide variety of types. The molded housing defines a pan-shaped structure that has a forwardly facing recess for nesting an operating handle. A pair of threaded mounting studs have enlarged head portions that are embedded in the molded material of the housing so that the threaded studs project rearwardly from a back wall of the housing for receiving mounted posts that are threaded onto the studs for mounting latch and lock operating components, and for establishing connections with a mounting bracket.

While latch and lock structures that embody the preferred practice of the present invention have latch bolts of the spring-projected slide-mounted type, not all of the features of the invention are limited to use with spring-projected latch bolts, as will be apparent to those skilled in the art from the description and claims that follow.

BRIEF DESCRIPTION OF THE DRAWINGS

These and other features, and a fuller understanding of the invention may be had by referring to the description and claims that follow, taken in conjunction with the accompanying drawings, wherein:

DESCRIPTION OF THE PREFERRED EMBODIMENT

Figure 1:
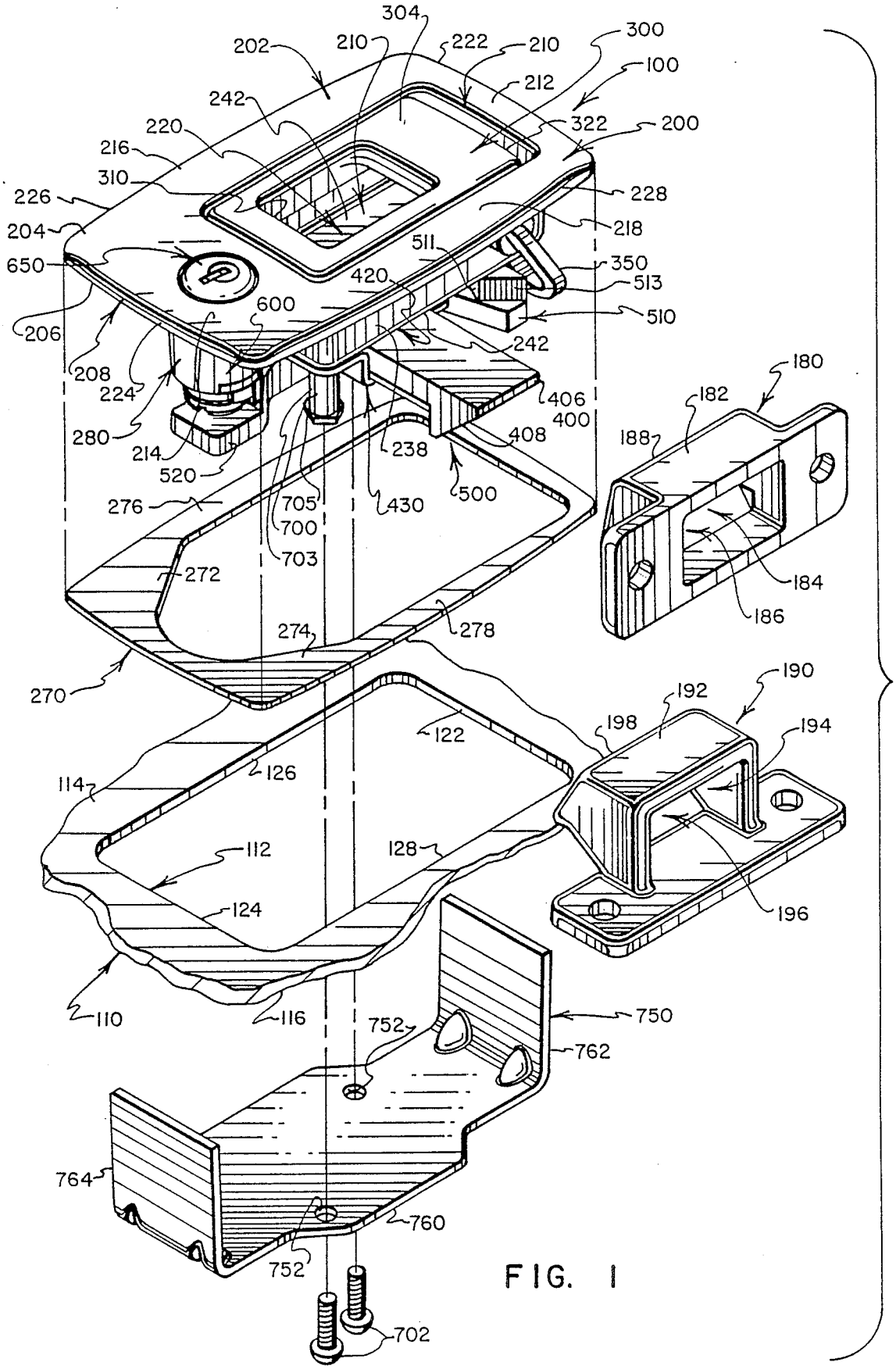
FIG. 1 is an exploded perspective view of one form of lock assembly that embodies features of the preferred practice of the present invention, illustrating how the lock assembly is mounted on a closure, and showing two types of strikers that may be used with the lock assembly.

Referring to FIG. 1, one form of a lock assembly that embodies features of the preferred practice of the present invention is indicated generally by the numeral 100. The lock assembly 100 has a housing 200 that mounts a plurality of interactive components that provide latching and locking functions. In preferred practice, latch and lock components that are described below are formed either from a durable thermoplastics material that will be described, or from stainless steel, whereby the resulting latch and lock units can be utilized in most normal environments without concern about deterioration from causes such as corrosion.

In overview, and as will be explained in greater detail, the interactive components that are carried on the housing 200 principally include a handle 300 that is mounted on the housing 200 for movement between normal and operating positions; a spring-projected latch bolt 400 that is mounted on the housing 200 for movement between latched and unlatched positions; an operating linkage 500 that drivingly interconnects the handle 300 and the latch bolt 400 for moving the latch bolt 400 to its unlatched position in response to movement of the handle 300 to its operating position; and, a locking mechanism 600 for selectively permitting and preventing movement of the latch bolt 400 by the handle 300. If the locking mechanism 600 is omitted, the lock assembly 100 is thereby transformed into a latch assembly, i.e., a unit which has a handle 300 that always can be operated to retract the latch bolt 400.

Appearance features of the combined housing and handle (i.e., the housing 200 and the handle 300) are shown in greater detail in the referenced Design Case II. Appearance features of the housing 200 as used with other handles are disclosed in the referenced Design Cases IV, VI and VII.

Referring to FIG. 1, it will be seen that the latch bolt 400 projects relatively sidewardly with respect to the housing 200 for engaging a suitably configured keeper or other structure that is located adjacent the lock assembly 100 when a closure 110 (on which the lock assembly 100 is mounted) is "closed." Examples of suitably configured bolt-engaging keeper structures include strikers 180, 190 that are depicted in FIG. 1; however, those skilled in the art will understand that other types of strikers, as well as keeper formations of conventional, commercially available configurations, also may be used to engage and releasably retain the latch bolt 400.

The strikers 180, 190 have body structures 182, 192 that surround and define bolt-receiving chambers 184, 194, respectively. Openings 186, 196 are formed in the body structures 182, 192 and communicate with the chambers 184, 194, respectively. The openings 186, 196 are of adequate size to receive and releasably retain a tip portion of the latch bolt 400. Inclined surfaces 188, 198 are provided on the strikers 180, 190 to enable a tapered tip portion of the latch bolt 400 to be "slammed" into engagement with the strikers 180, 190, whereby the engagement of the latch bolt 400 with the inclined surfaces 188, 198 of the strikers 180, 190 will cause the latch bolt 400 to retract and pass by the surfaces 188, 198 on the way toward entering the openings 186, 196. Appearance features of the striker 180 are disclosed in greater detail in the referenced Design Case X. Appearance features of the striker 190 are disclosed in greater detail in the referenced Design Case XI.

Before turning to a more detailed description of the components of the lock assembly 100, the preferred manner in which the lock assembly 100 can be mounted on a closure 110 will be described. The portion of the closure 110 that is shown in FIG. 1 is a plate-like structure that has a mounting opening 112 formed therethrough. The closure portion 110 has a front surface 114 and a rear surface 116 that extend about the perimeter of the opening 112. The opening 112 has top and bottom boundaries 122, 124, and left and right side boundaries 126, 128.

In order to mount the lock assembly 100 on the closure 110, the lock assembly 100 has a pair of mounting posts 700 that project rearwardly for connection to a mounting bracket 750. The mounting bracket 750 is of generally U-shaped configuration, having a back wall 760 that connects at opposite ends with legs 762, 764. The legs 762, 764 extend forwardly from the plane of the back wall 760 toward the mounting flange 202, and cooperate with the housing 200 for clampingly mounting the lock assembly 100 on the closure 110. Appearance features of the mounting bracket 750 are disclosed in greater detail in the referenced Design Case VIII, as are other forms of mounting brackets that also may be used.

When the lock assembly 100 is to be installed on the closure 110, a gasket 270 is positioned to engage the mounting flange 202, and portions of the lock assembly 100 are installed through the closure opening 112 to position the gasket 270 adjacent the opening 112 in clamped engagement between the rear face 206 of the mounting flange 202 and the front surface 114 of the closure 110. The mounting bracket 750 is positioned to overlie the lock assembly 100, with the legs 762, 764 of the mounting bracket 750 extending into engagement with the rear surface 116 of the closure 110. Threaded fasteners 702 are installed to extend through holes 752 that are formed through the back wall 760 of the bracket 750. The fasteners 702 are threaded into the mounting posts 700 of the lock assembly 100 to clamp the mounting flange 202 into engagement with the gasket 720, to clamp the gasket 720 into engagement with the front surface 114, and to clamp the legs 762, 764 into engagement with the rear surface 116.

Figure 6:
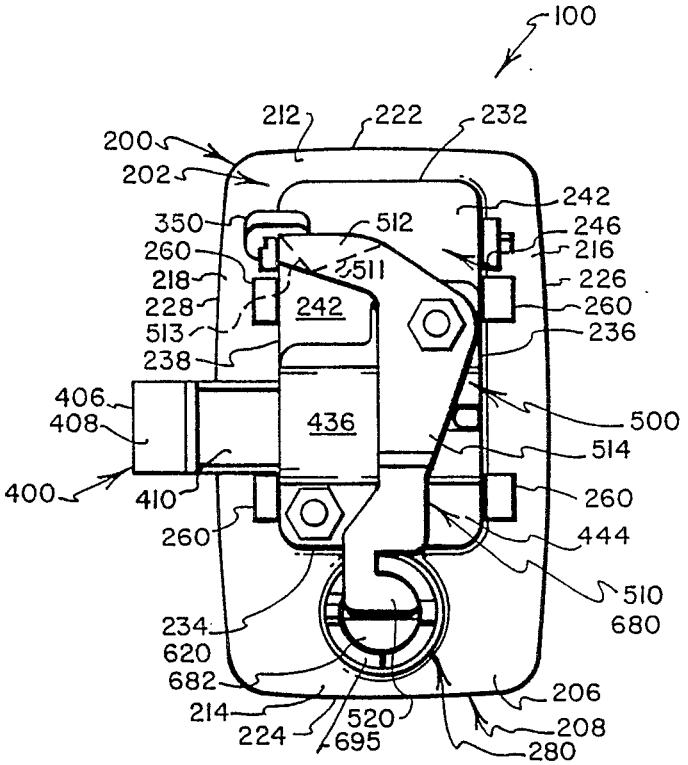
FIG. 6 is a rear elevational view similar to FIG. 4, but with the locking components unlocked.
Figure 7:
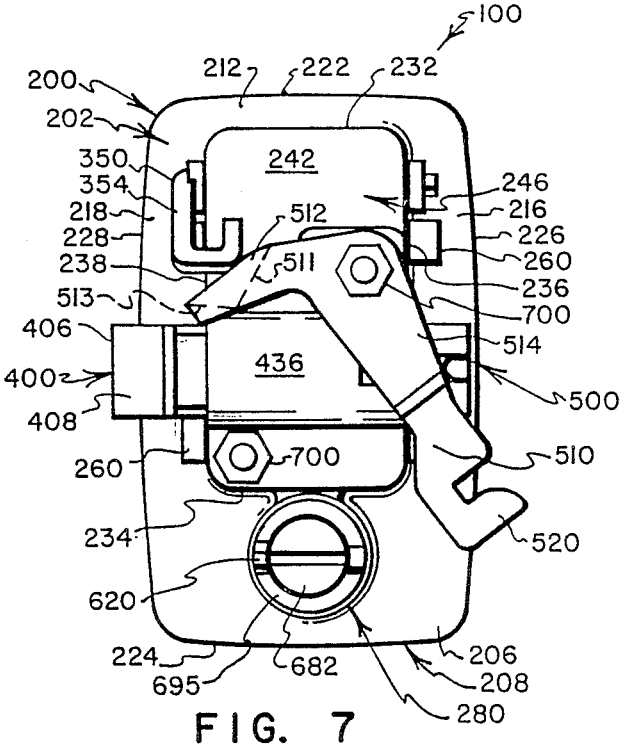
FIG. 7 is a rear elevational view similar to FIG. 6, but with the handle operated and with the latch bolt retracted to its unlatched position.
Figure 10:
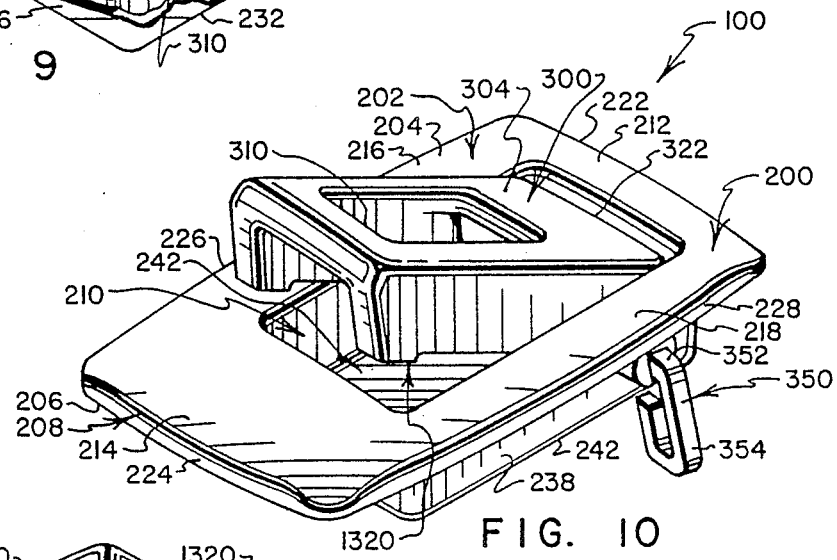
FIG. 10 is a perspective view similar to FIG. 1, but showing only selected portions of the housing and other parts of the lock assembly, with the handle shown in its operated position whereby an operating arm that pivots with the handle also is moved to its operating position.

To facilitate an understanding of the various relative positions of the principal relatively movable components of the lock assembly 100, reference is made to FIGS. 1 and 3–6 wherein the handle 300 is in its "normal" or "nested" position; the latch bolt 400 is in its "latched" or "projected" position; and the lock mechanism 600 is "locked" so as to prevent unlatching movement of the latch bolt 400 in response to attempted operation of the handle 300. In FIG. 6, the mechanism of the lock 600 is shown "unlocked" so as to permit unlatching movement of the latch bolt 400 by operation of the handle 300. In FIGS. 7 and 10, the handle 300 is shown in its "operating" position wherein the handle 300 functions (in conjunction with the operation of other components, as will be described) to retract the latch bolt 400 to its "unlatched" position.

In the detailed description that follows, the lock assembly 100 and three alternate lock assembly embodiments 1100, 2100, 3100 will be described. Features of the lock assembly 100 are depicted in FIGS. 1–10. Features of the alternate lock assembly embodiments 1100, 2100, 3100 are depicted in FIGS. 11–20, FIGS. 21–30 and FIGS. 31–40, respectively. To the extent that the lock assemblies 100, 1100, 2100, 3100 use identical parts, identical reference numerals are used to designate the identical parts. To the extent that the lock assemblies 100, 1100, 2100, 3100 use slightly differently configured parts that function substantially identically, reference numerals that differ by magnitudes of 1000, 2000 and 3000 are used to identify these components—whereby many of the features that are designated by four-digit reference numerals need not be described inasmuch as the character of these features will be apparent from the discussion that is presented of features that are designated by three digit reference numerals.

The lock assemblies 100, 1100, 2100 and 3100 share a general layout of operating components, with many of the operating components being interchangeable from lock to lock. Features shared by all four of these lock embodiments include spring-projected latch bolts 400 of identical construction; the use of latch bolt slide housings 430 of identical construction; the use of pivotally mounted L-shaped operating arms 510, 2510 of basically similar character which drivingly connect the slide bolts 400 with their associated operating handles 300, 1300, 2300, 3300; and the identical manner in which secure locking connections are established between each of the pivotally mounted operating arms 510, 2510 and its associated key cylinder assembly 610 to selectively permit and prevent handle movement to retract an associated one of the latch bolts 400.

Principal areas of difference among the lock embodiments 100, 1100, 2100, 3100 reside in the configuration of their handles 300, 1300, 2300, 3300; the movements that are executed by the handles 300, 1300, 2300, 3300 to effect latch bolt retraction; the mountings of the handles on their associated housings 200, 1200, 2200, 3200; and the character of such handles extensions as project through a back wall or side wall opening(s) of the pan-shaped part 220, 1220, 2220, 3220 of the housings for engaging operating arms 510, 2510.

Turning now to a more detailed description of features of the components of the lock assembly 100, the housing 200 is preferably formed as a molded, one piece structure; thus it will be understood that the mounting flange 202 together with the walls that form an essentially pan-shaped housing portion 220 (i.e., the walls that define the width, length and depth of the recess 210) are integrally-formed parts of the same one-piece structure. The fabrication of the housing 200 as a one-piece member molded from thermoplastic, material such as a glass reinforced polycarbonate based polymer blend helps to provide a strong, rigid, impact resistant structure, whereby the housing 200 is capable of providing a versatile mounting platform for supporting the various relatively movable components of the lock assembly 100.

A preferred material from which the housing 200 is formed is a thermoplastic that is a glass reinforced polycarbonate based polymer blend, typically of the type sold by General Electric Company, Pittsfield, MA 01201 under the registered trademark XENOY. The most preferred resin blend is about 10 percent glass reinforced, and is selected from the "6000 Series" of the XENOY products sold by General Electric, with XENOY 6240 being preferred. While many other commercially available moldable plastics materials can be used to form the housing 200, as will be apparent to those skilled in the art, the preferred material helps to provide a high strength housing that is light in weight, resists crazing and hardening, is heat and chemical resistant, is resistant to impact, and can be machined as needed to provide suitable mounting holes and the like for movably mounting a wide variety of handles within the confines of the recess 210, as will be explained.

The mounting flange 202 has a front face 204 that defines the front of the housing 200. The mounting flange 202 has a rear face 206 that is substantially flat, i.e., all portions of the rear face 206 extend substantially in a single plane. The mounting flange 202 is bordered by a perimetrically extending edge surface 208 that joins the front and rear surfaces 204, 206 at their peripheries. While all portions of the mounting flange 202 are formed integrally and therefore serve to define elements of a one-piece structure, for purposes of reference, the mounting flange 202 can be thought of as having a top portion 212 that extends across the top of the recess 210, a bottom portion 214 that extends across the bottom of the recess 210, and opposed side portions 216, 218 that extend along left and right sides of the recess 210. Likewise, the edge surface 208 can be thought of as having a top portion 222, a bottom portion 224, and opposed side portions 226, 228. The flange portions 212, 214, 216, 218 and their associated edge portions 222, 224, 226, 228 cooperate to define a mounting flange 202 that has a generally rectangular configuration, with corner regions where adjacent ones of the edge portions 222, 224, 226, 228 join preferably being gently rounded to give an enhanced appearance.

The pan-shaped portion 220 of the housing 200 (i.e., the portion of the housing 200 that defines the forwardly facing recess 210) includes a top wall 232, a bottom wall 234, a pair of opposed side walls 236, 238, and a back wall 242. The back wall 242 is arranged so that it extends substantially parallel to the rear face 206 of the mounting flange 202. Stated in another way, the back wall 242 has a front face 244 and a rear face 246 that extend in planes that substantially parallel the plane of the rear face 206. Particular attention is paid to the molding of the rear face 246 of the back wall 242 so that the rear face 246 provides a smooth, planar back wall surface that can be utilized for the important functions of mounting and guiding the movement of other components of the lock assembly 100, as will be explained.

For the purpose of providing an enhanced appearance, it is preferred that front face 204 of the housing 200 be of curved, slightly convex configuration. Stated in another way, the front face 204 is convexly curved such that the thicknesses of the mounting flange portions 212, 214, 216, 218 increase progressively the closer these formations extend toward an imaginary center point of the front face 204. Likewise, the thicknesses of the mounting flange portions 212, 214, 216, 218 decreases progressively as these formations extend toward the edge surface portions 222, 224, 226, 228. Preferably, the thicknesses of the mounting flange portions 212, 214, 216, 218 as measured at locations that are adjacent to the edge portions 222, 224, 226, 228, are substantially uniform all along the edge surface 208—which is to say that the edge surface 208 has a width that is substantially constant as the edge surface 208 extends about the housing 200. Appearance features of the front face 204 of the housing 200 are within the purview of the referenced Design Case I.

For the purpose of providing an enhanced appearance, the positioning of the top and bottom walls 232, 234 of the pan-shaped housing portion 220 that defines the recess 210 preferably is asymmetrical relative to top and bottom edges 222, 224 of the mounting flange 202. Likewise, for purposes of enhanced appearance, the positioning of the left and right side walls 236, 238 of the pan-shaped housing portion 220 preferably is asymmetrical relative to the left and right opposed side edges 226, 228 of the mounting flange 202. This absence of symmetry in locating the recess 210 relative to opposed top and side edge portions 222, 224 and 226, 228 of the mounting flange 202 results in the top wall portion 212 being relatively short in height in comparison with the relatively tall height of the bottom wall portion 214 that depends beneath the recess 210, and results in the left sidewall portion 216 being relatively wide, while the right side wall portion 218 is a relatively narrow.

Figure 4:
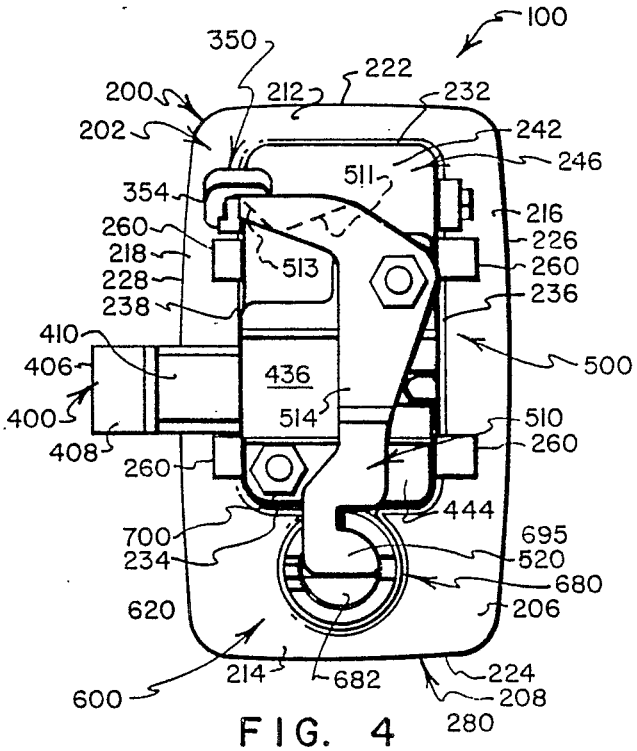
FIG. 4 is a rear elevational view thereof.
Figure 5:
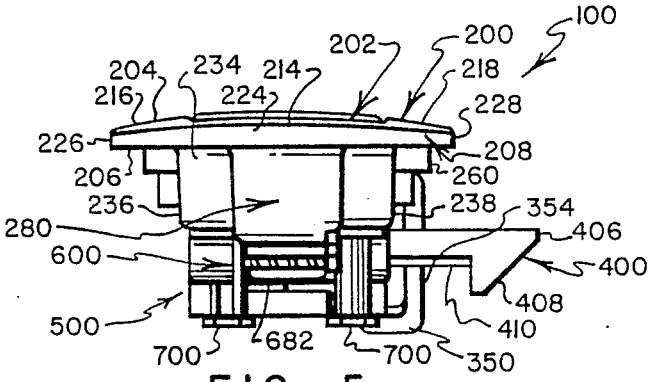
FIG. 5 is a bottom plan view thereof.
Figure 8:
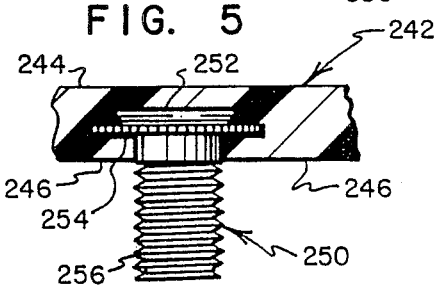
FIG. 8 is a sectional view, on an enlarged scale, as seen from a plane indicated by a line 6—6 in FIG. 2.

A feature of the present invention resides in the provision of compact, simply configured locks and latches having spring projected latch bolts, with the functional, operating components thereof being arranged substantially symmetrically about an imaginary, vertically extending center plane, designated by the numeral 201 in FIG. 4. In this regard, it will be understood that several functional features of the housing 200 are arranged substantially symmetrically about the center plane 201, including the side walls 236, 238 of the housing portion 220, and a sleeve-like housing formation 280, which will be described.

With respect to the side-to-side positioning of the recess 210 relative to features of the mounting flange 202, however, it will be understood that this is a feature dictated solely by appearance considerations, and not by functional considerations. Indeed, functional features of the lock assembly 100 would not be affected if the narrow flange portions 212, 218 were enlarged to give the flange portions 212, 218 widths that are equivalent to the relatively wider flange portions 214, 216, respectively. Likewise the styling of the front face 204 of the mounting flange 202 is dictated entirely by appearance considerations.

Threaded studs 250 project rearwardly from the rear face 246 of the back wall 242 for mounting various latch and lock components, as will be explained. Referring to FIG. X, the threaded studs 250 have enlarged head portions 252 with radially outwardly extending projections 254 that have somewhat of a toothed washer appearance and that are located adjacent the head portions 252. The head portions 252 and the projections 254 are embedded within the molded material of the back wall 242 of the housing 200 to provide structures that are anchored securely to the material of the plastic and will not rotate with request thereto. The studs 250 have elongate threaded shank portions 256 that project rearwardly from the head portions 252. The threaded shank portions 256 extend along spaced imaginary axes 251 that intersect the plane of the back wall 242 at right angles thereto. The axes 251 extend coaxially through the holes 752 that are formed in the back wall 760 of the mounting bracket 750. The axes 251 of the studs 250 are located equidistantly from the center plane 201, and are positioned on opposite sides of the center plane 201.

In preferred practice, the threaded studs 250 are commercially available fasteners that are sold by Penn Engineering and Mfg. Corp. of Danboro, PA, under the trademark PEM. The preferred part is model number CHN-832-4, is formed from stainless steel, has a tapered head 252 with a maximum diameter of about 0.289 inch, has radially extending projections portions 254 with a maximum outer diameter of about 0.328 inch, and has a shank length of about 0.250 inch that is threaded with a standard thread such as 8-32 NC. While these commercially available fasteners are intended for use with sheet metal, not plastic, they have been found to be quite suitable for use in the application described here.

Locator projections 260 are provided at spaced locations along the side walls 236, 238 at junctures of the side walls 236, 238 with the rear face 206 of the mounting flange 202. As will be seen in FIG. 4, the locator projections 260 are arranged symmetrically in pairs on opposite sides of the center plane 201. The locator projections 260 are intended to directly engage opposite sides 126, 128 of the opening 112 to orient the lock assembly 100 properly on the closure 110; however, if the opening 112 has been formed so as to be slightly "oversized," the locator projections 260 may be utilized during installation of the lock assembly on the closure 110 as "guides" to visually aid in properly positioning the housing 200 with respect to the closure opening 112, preferably with the locator projections 260 being arranged to be spaced substantially equidistantly from opposite side portions 126, 128 of the opening 112.

While the gasket 270 is not essential in many applications where the lock assembly 100 can be used, the gasket 270 preferably is used in applications that present a possibility that moisture may penetrate the opening 112 as by passing between the back face 206 of the mounting flange 202 and the front face 114 of the closure 110. To aid in properly positioning the gasket 270 about the lock assembly 100, the gasket 270 has an asymmetrical configuration that causes the gasket 270 to extend in an obviously skew, out-of-alignment relationship with respect to the edge portions 226, 228 of the mounting flange 202 if the gasket 270 is installed incorrectly, e.g., in an "inside-out" manner. Specifically, the gasket 270 has a relatively wide left side portion 276 that underlies the relatively wide left side wall 236; similarly, the gasket 270 has a relatively narrow right side portion 278 that underlies the relatively narrow right side wall 238. Further, the gasket 270 has a relatively large, generally triangular-shaped corner region 272 that is configured to underlie a correspondingly large corner portion of the bottom wall 214 of the mounting flange 202, and a relatively smaller, generally triangular shaped corner region 274 that is configured to underlie a correspondingly smaller corner portion of the bottom wall 214 of the mounting flange.

The sleeve-like formation 280 of the housing 200 is located below the recess 210 and extends rearwardly from the rear face 206 of the mounting flange 202 along the bottom wall 234 of the housing portion 220. In preferred practice, the sleeve formation 280 is provided on the housing 200 regardless of whether the sleeve formation 280 is to be utilized to house operating components of a latch or lock.

If the sleeve formation 280 is to be utilized to house latch or lock components, an opening 282 is formed through the front wall 204 to communicate with a passage 284 that extends through the sleeve formation 280. The opening 282 and the passage 284 extend coaxially along an imaginary axis 281 (see FIG. 2) that lies within the imaginary center plane 201 and that extends substantially perpendicular to the planes of the rear face 206 and the back wall 246. If the sleeve formation 280 is not to be utilized to house latch or lock components, either no opening 282 is formed through the front wall 204, or a suitably configured plug (not shown) is installed in the opening 282 to close the opening 282.

Figures 41, 42:
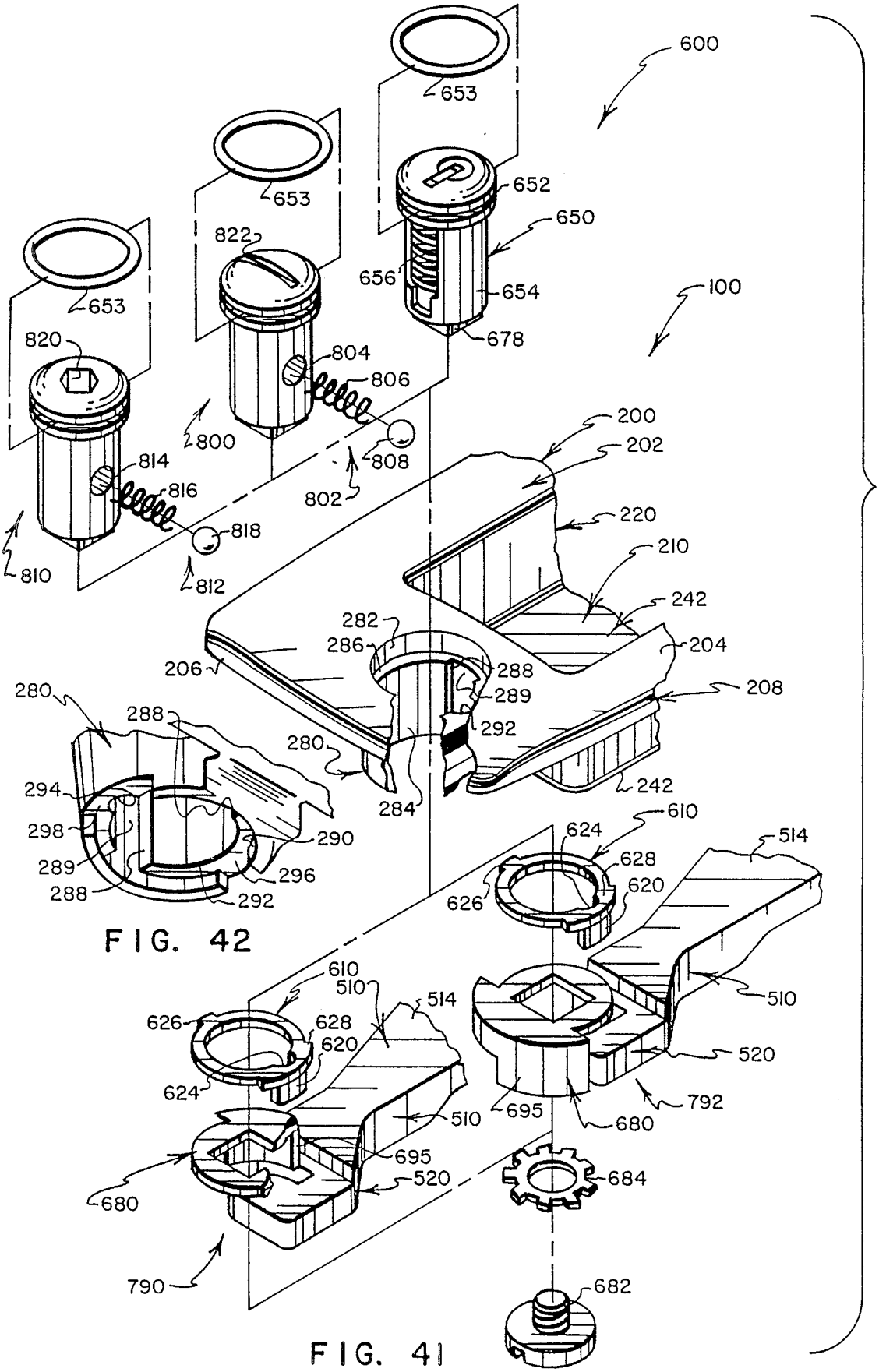
FIG. 41 is an exploded perspective view, on an enlarged scale, of selected portions of the lock assembly of FIGS. 1–7, with the view showing alternate tool-operated plugs that can be installed in the lock housing, and with the view showing locked and unlocked positions of selected components of the locking mechanism of the lock assembly of FIGS. 1–7, it being understood that what is depicted in FIG. 41 is equally applicable to the lock assemblies of FIGS. 10–17, 20–27 and 30–37; and, FIG. 42 is a perspective view of rear portions of the housing that is shown in FIG. 41.

Referring to FIG. 41, a shoulder 286 extends substantially radially with respect to the axis 281 to form a transition between the relatively large diameter of the opening 282 and the relatively smaller diameter of the passage 284. Axially extending top and bottom grooves 288 are formed in opposed upper and lower portions of the passage 284. Referring to FIG. 42, the grooves 288 extend axially rearwardly from the shoulder 286 and have bottom walls 289 that are curved and represent continuations of a cylindrical surface 290 of enlarged diameter that is formed in the rearward end region of the sleeve 280. A radially extending shoulder 292 forms a transition between the passage diameter that is designated by the numeral 284, and the enlarged diameter end region 290. A rounded groove 294 of shallower depth than the grooves 288 is formed in a side of the passage portion 284. The rounded groove 294 extends from the shoulder 286 to the shoulder 292.

Two opposed portions 296, 298 of the shoulder 292 extend radially outwardly and interrupt opposed side portions of the sleeve formation 280 to provide radially extending, rearwardly opening notches that are designated by the numerals 296, 298.

In preferred practice, the housing 2800 is formed without any openings, holes, slots or the like extending through the walls that define the recess 210, i.e., the top, bottom, and side walls 232, 234, 236, 238, and the back wall 242 are smooth and have no openings formed therethrough. Depending on the type of handle that is to be used with the housing 200, and on the type of latch or lock operating mechanism that is to be mounted on the housing 200, one or more suitable passages through the housing 200 are machined in the form of openings, holes, slots and the like which formed as by drilling, milling or other conventional machining techniques.

Figure 20:
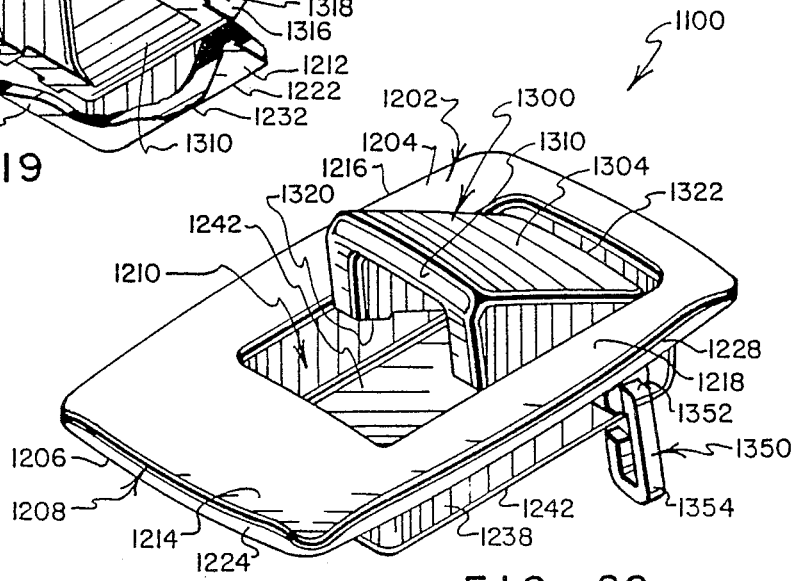
FIG. 20 is a perspective view similar to FIG. 11, but showing only selected portions of the housing and other parts of the lock assembly, with the handle shown in its operated position whereby an operating arm that pivots with the handle also is moved to its operating position.
Figure 11:
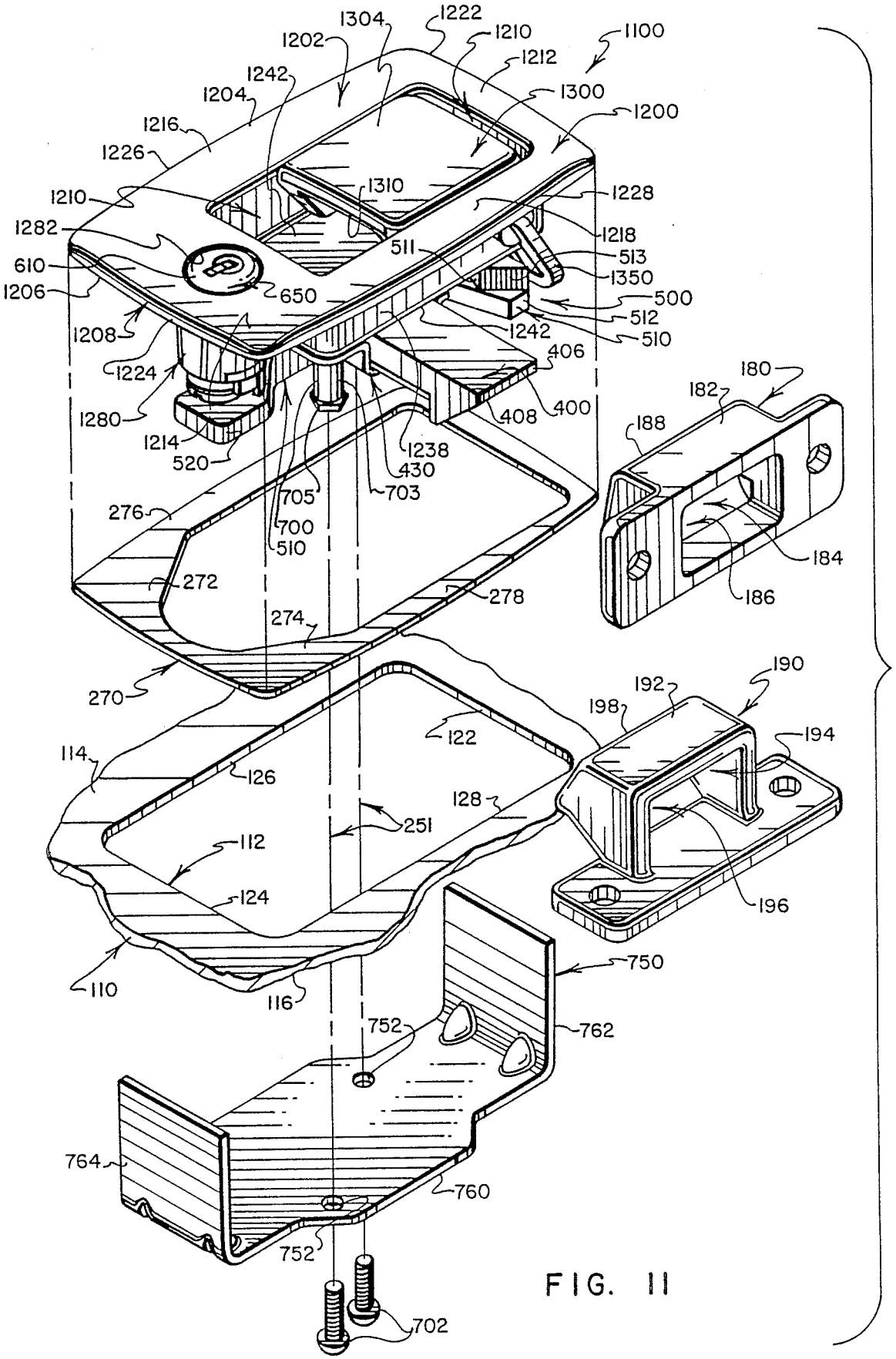
FIG. 11 is a perspective view of another form of lock that embodies features of the preferred practice of the present invention illustrating how the lock assembly is mounted on a closure, and showing two types of strikers that may be used with the lock assembly.
Figure 30:
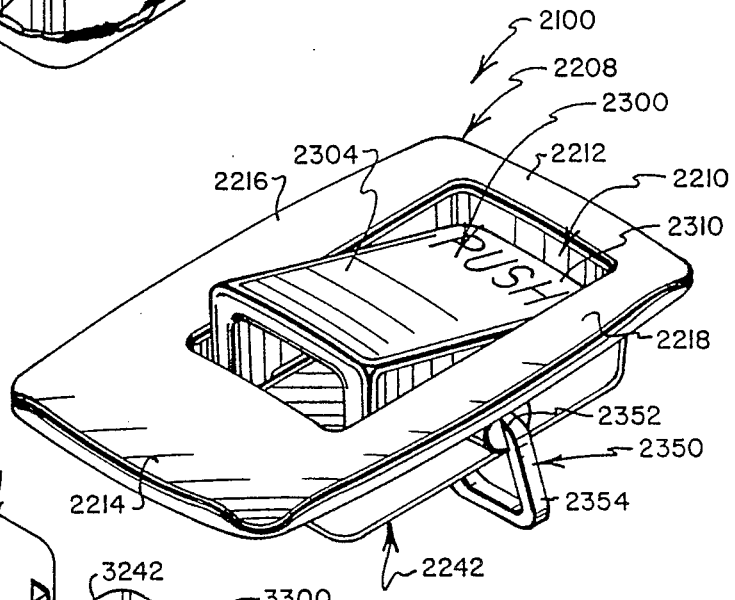
FIG. 30 is a perspective view similar to FIG. 21, but showing only selected portions of the housing and other parts of the lock assembly, with the handle shown in its operated position whereby an operating arm that pivots with the handle also is moved to its operating position.
Figure 40:
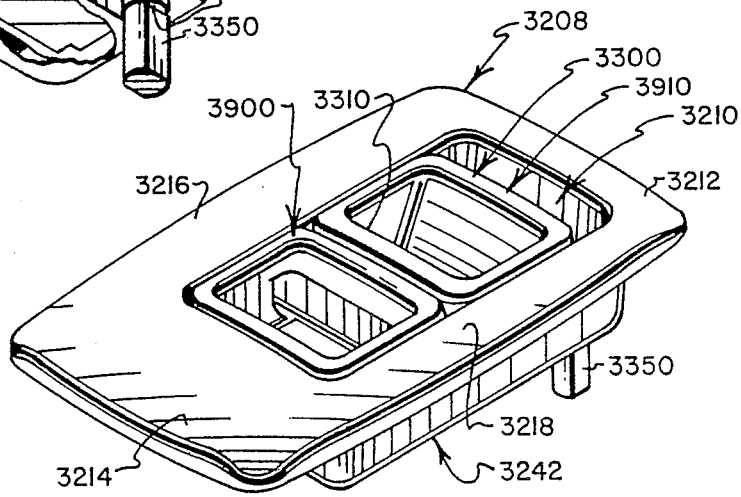
FIG. 40 is a perspective view similar to FIG. 31 but showing only selected portions thereof, with the handle in its operated position.
Figure 31:
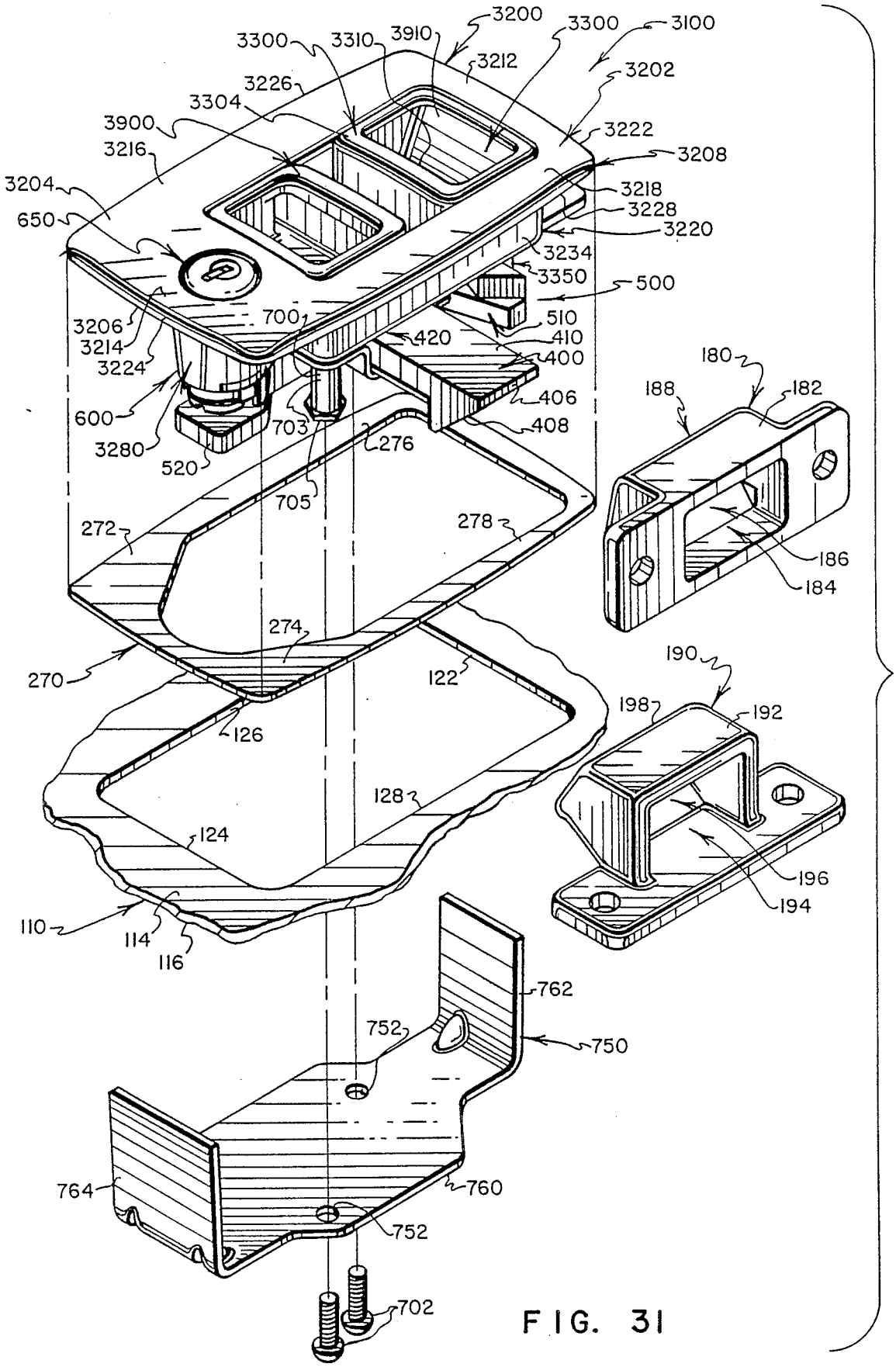
FIG. 31 is a perspective view of another form of lock that embodies feature of the preferred practice of the present invention illustrating how the lock assembly is mounted on a closure, and showing two types of strikers that may be used with the lock assembly.
Figure 32:
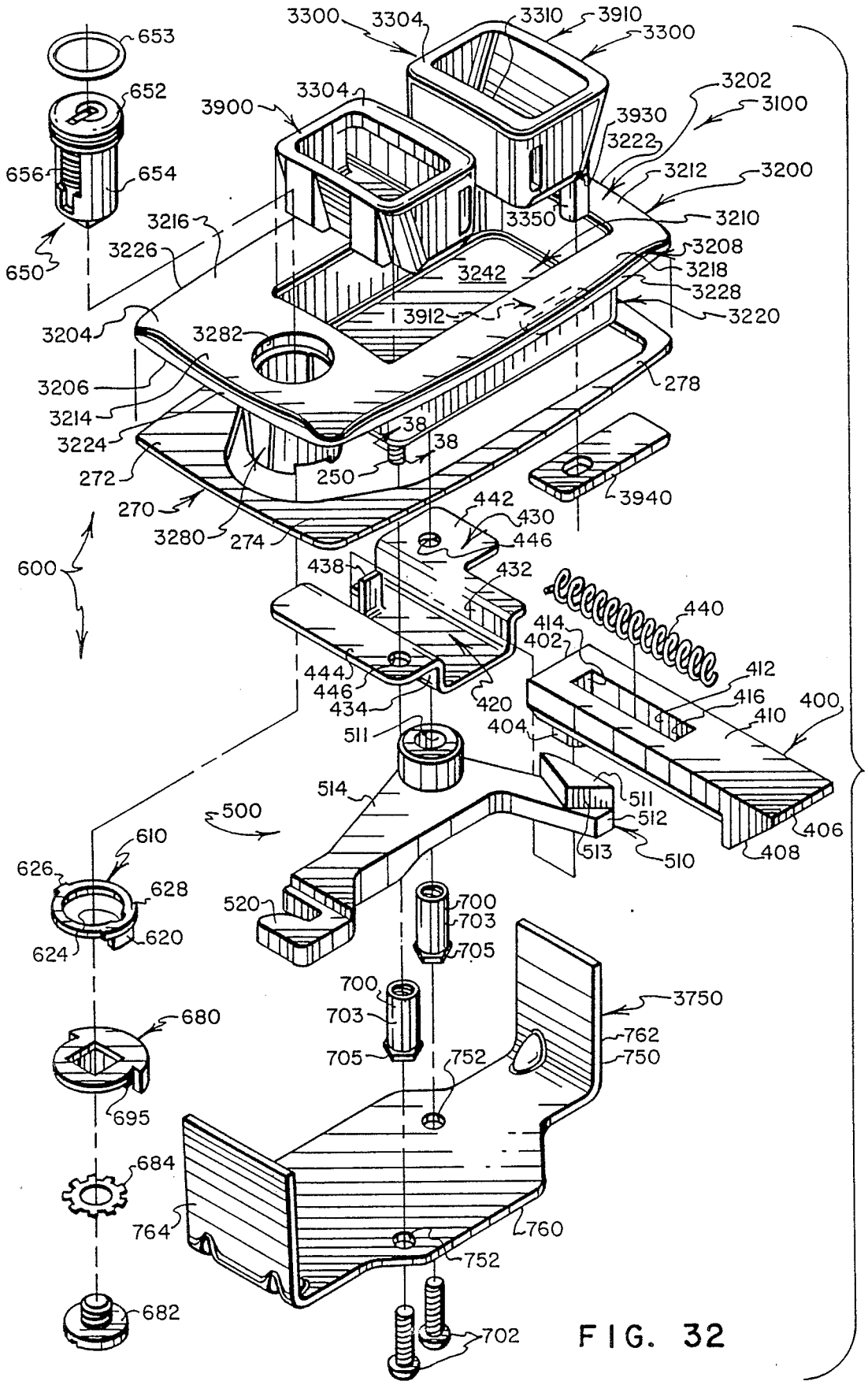
FIG. 32 is an exploded perspective view of components of the lock assembly of FIG. 31.
Figure 33:
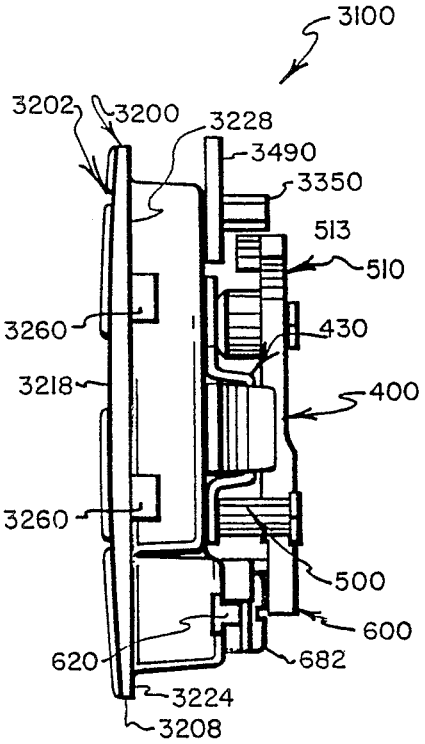
FIG. 33 is a right side elevational view thereof, with the handle in its normally nested position, with the latch bolt projected to its latched position, and with locking components locked.
Figure 34:
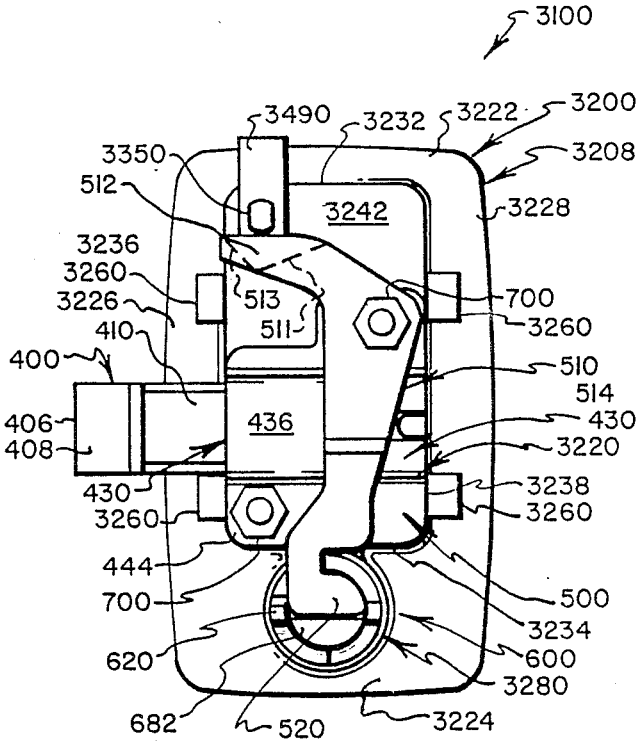
FIG. 34 is a rear elevational view thereof.
Figure 35:
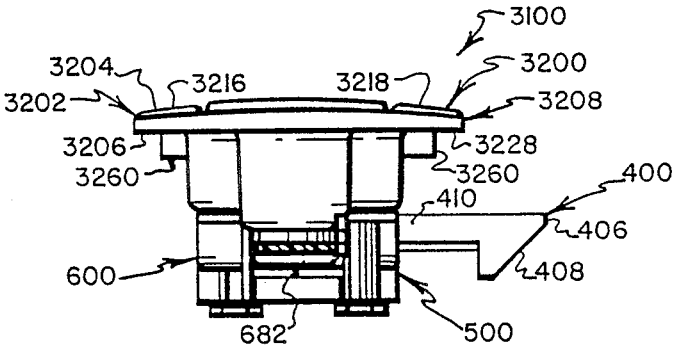
FIG. 35 is a bottom plan view thereof.
Figure 38:
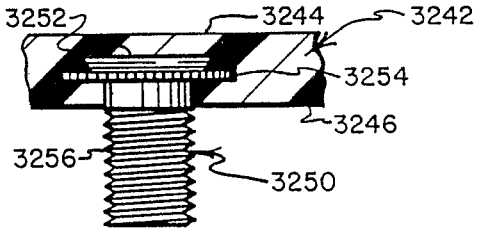
FIG. 38 is a sectional view as seen from a plane indicated by a line 38—38 in FIG. 32.
Figure 36:
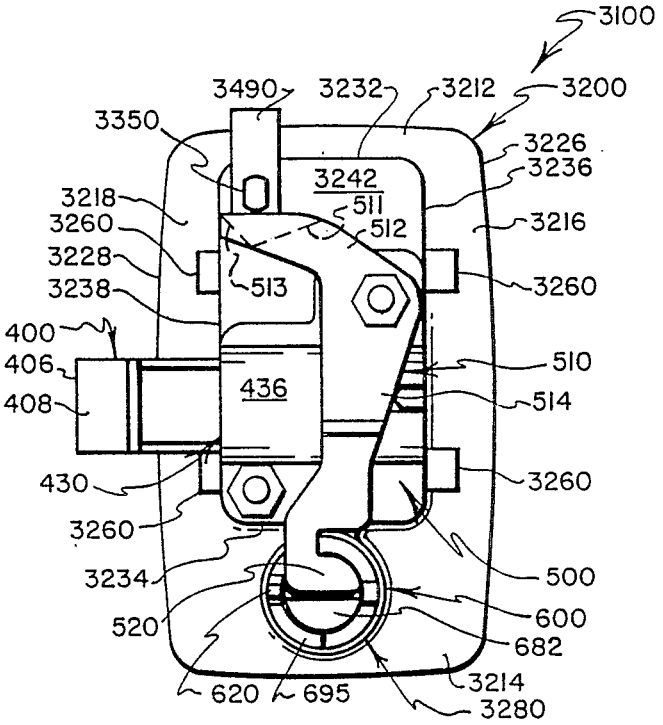
FIG. 36 is a rear elevational view similar to FIG. 34 but with the locking components unlocked.
Figure 37:
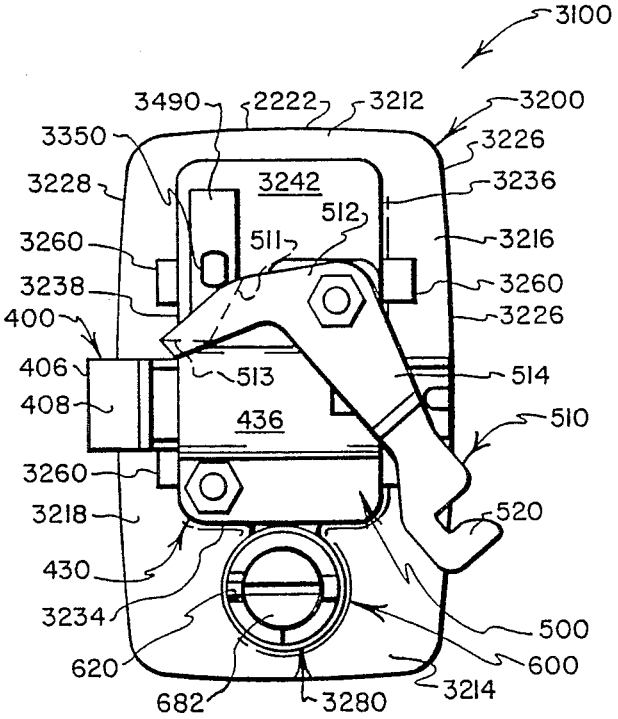
FIG. 37 is a rear elevational view similar to FIG. 36 but with the handle operated and with the latch bolt retracted to its unlatched position.

The handles 300, 1300, 2300 and 3300 that are used in the housings 200, 1200, 2200 and 3200 are formed from molded plastics material, preferably of the same thermoplastics material from which the housings 200, 1200, 2200 and 3200 are formed. The handles 300, 1300, 2300, 3300 have front surface portions 304, 1304, 2304, 3304 that are of complexly curved, generally convex shape, and are configured to extend in a flush, substantially contiguous manner to smoothly continue the curvature of the complexly curved, convex front surfaces 204, 1204, 2204, 3204 of the mounting flange 202, 1202, 2202, 3202 when the handles 300, 1300, 2300, 3300 are in their normal or nested position. The handle 300 is mounted on the housing 200 for movement between a normally nested position that is, shown in FIGS. 1 and 3–5, and an operating position that is depicted in FIG. 10. The handle 1300 is mounted on the housing 200 for movement between a normally nested position that is, shown in FIGS. 11 and 13–15, and an operating position that is depicted in FIG. 20. The handle 2300 is mounted on the housing 200 for movement between a normally nested position that is, shown in FIGS. 21 and 23–25, and an operating position that is depicted in FIGS. 30. The handle 3300 is mounted on the housing 200 for movement between a normally nested position that is, shown in FIGS. 31 and 33–35, and an operating position that is depicted in FIGS. 40.

Figure 9:
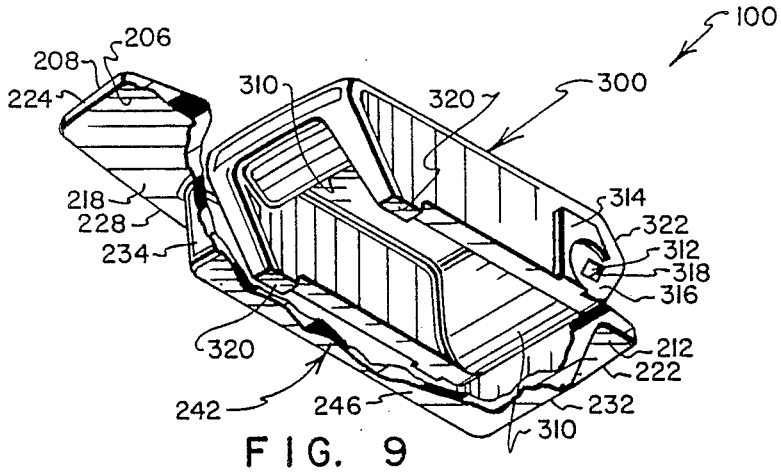
FIG. 9 is a perspective view of selected portions of the handle and the housing of the lock assembly of FIGS. 1–7, with the view showing principally rear portions of the handle, and with portions of the housing broken away.
Figure 19:
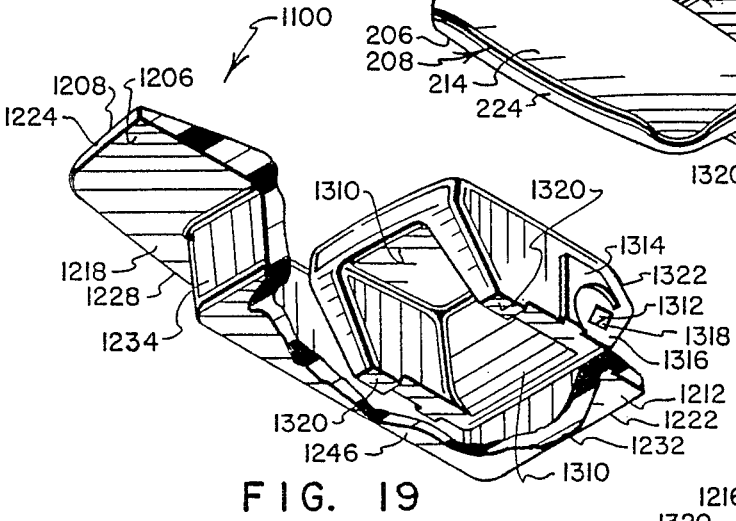
FIG. 19 is a perspective view of selected portions of the handle and the housing of the lock assembly of FIGS. 11–17, with the view showing principally rear portions of the handle, and with portions of the housing broken away.
Figure 29:
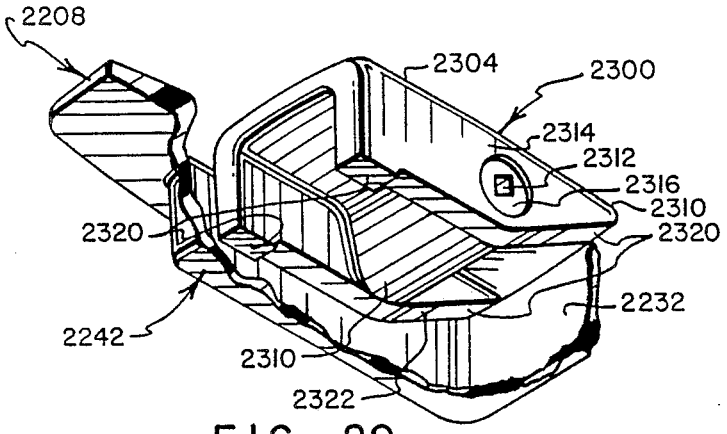
FIG. 29 is a perspective view of selected portions of the handle and the housing of the lock assembly of FIGS. 21–27, with the view showing principally rear portions of the handle, and with portions of the housing broken away.

The handles 300, 1300, 2300 and 3300 have shapes that let them nest and move with ease within he confines of their respective recesses 210, 1210, 2210, 3210. Referring to FIGS. 9, 19, and 29 the handles 300, 1300, 2300 have pivoted mounting portions 310, 1310, 2310 that extend transversely across the recesses 210, 1210, 2210 and provides through passages 312, 1312, 2312 of square cross section for receiving handle mounting shafts 350, 1350, 2350 that also is of square cross section. The opposed end regions 314, 1314, 2314 of the mounting portions 310, 1310, 2310 have cylindrical recesses 316, 1316, 2316 that surround the ends of the passages 312, 1312, 2312 for mounting O-rings 318.

Stop surfaces 320, 1320, 2320 are formed on depending portions of the handles 300, 1300, 2300 to engage the back walls 242, 1242, 2242 of the housings 200, 1200, 2200 when the handles 300, 1300, 2300 are nested in the recesses 210, 1210, 2210. Stop surface 322, 1322, 2322 are formed on the end regions of the handles 300 and 1300, and on the back of the handle 2300 for engaging the top walls 232, 1232 of the housing portions 220, 1220, and the back wall 2242 of the housing portions 2220 when the handles 300, 1300, 2300 are in their operating positions, as is shown in FIGS. 10, 20 and 30.

The handles 300, 1300, 2300, 3300 have operator engagement formations 310, 1310, 2310, 3310 that can be engaged by an operator's hand (preferably by one or more fingers thereof) for moving the handles 300, 1300, 2300, 3300 between their normal or nested positions and their operating positions.

Figure 2:
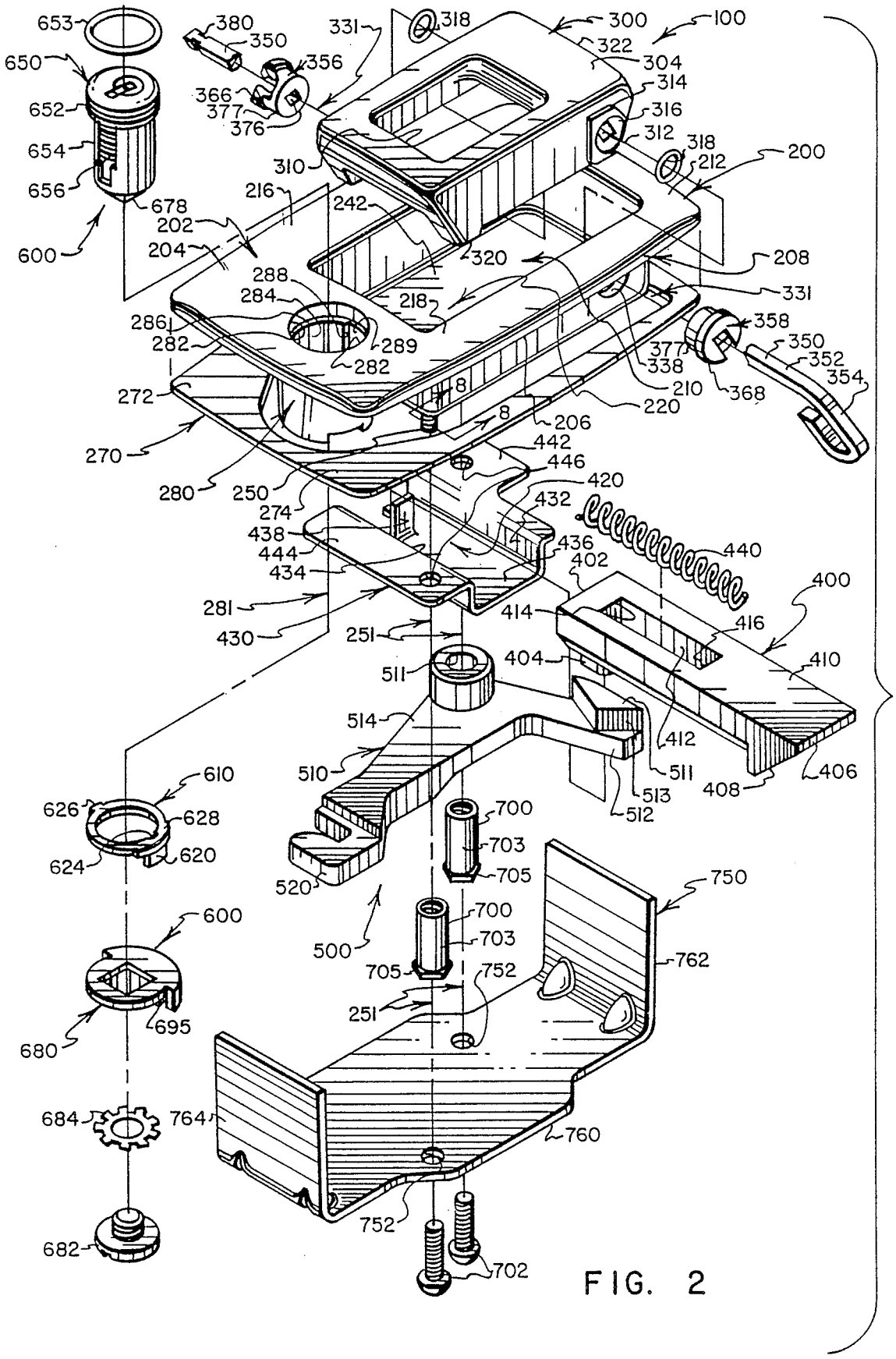
FIG. 2 is an exploded perspective view of components of the lock assembly of FIG. 1.
Figure 3:
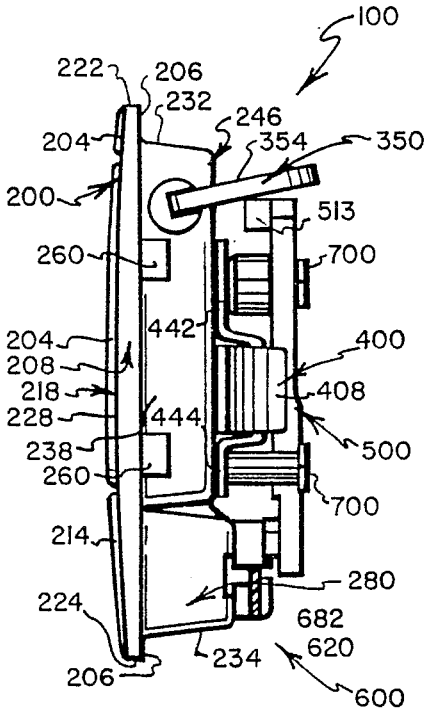
FIG. 3 is a right side elevational view thereof, with the handle in its normally nested position, with the latch bolt projected to its latched position, and with locking components locked.
Figure 12:
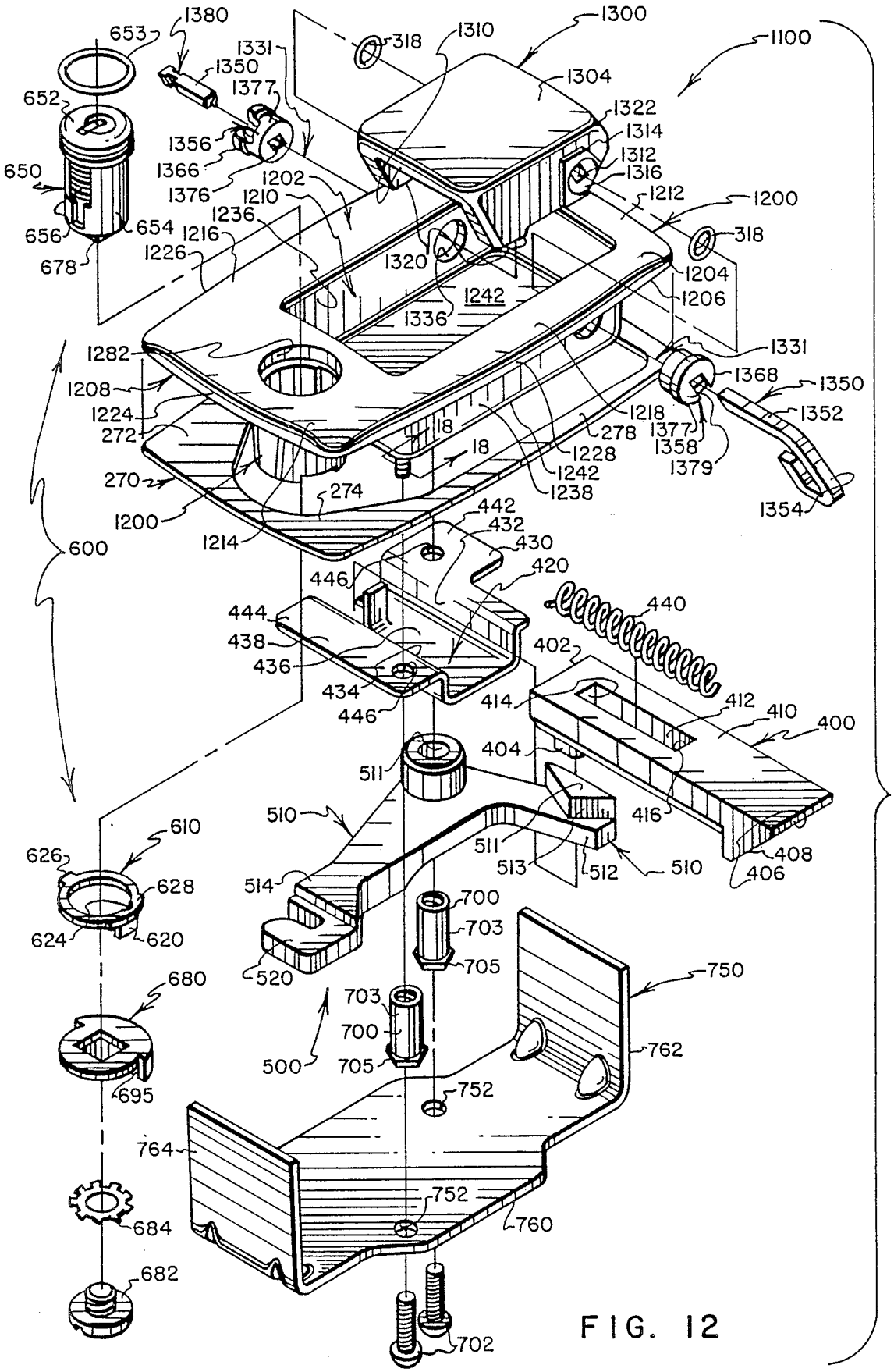
FIG. 12 is an exploded perspective view of components of the lock assembly of FIG. 11.
Figure 13:
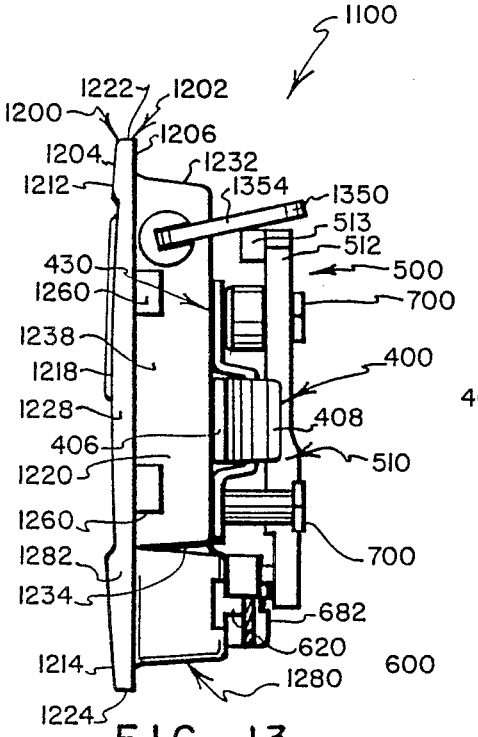
FIG. 13 is a right side elevational view thereof, with the handle in its normally nested position, with the latch bolt projected to its latched position, and with locking components locked.
Figure 14:
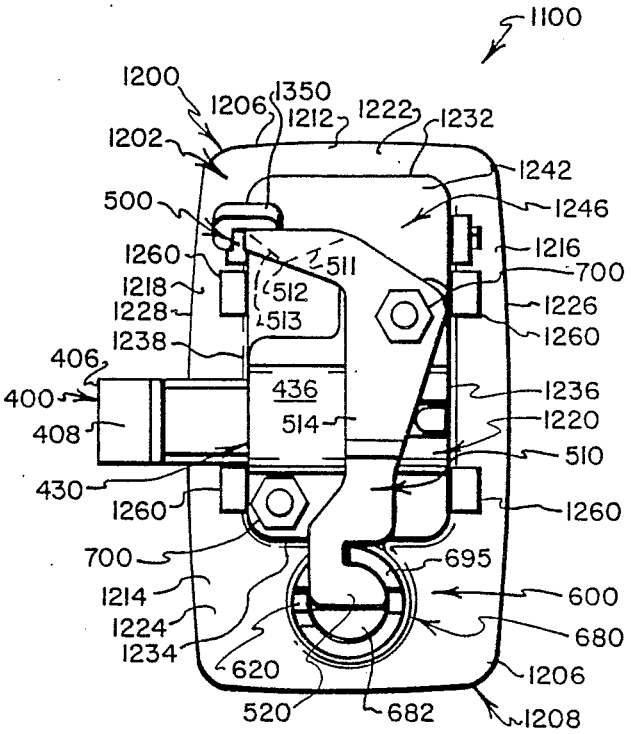
FIG. 14 is a rear elevational view thereof.
Figure 15:
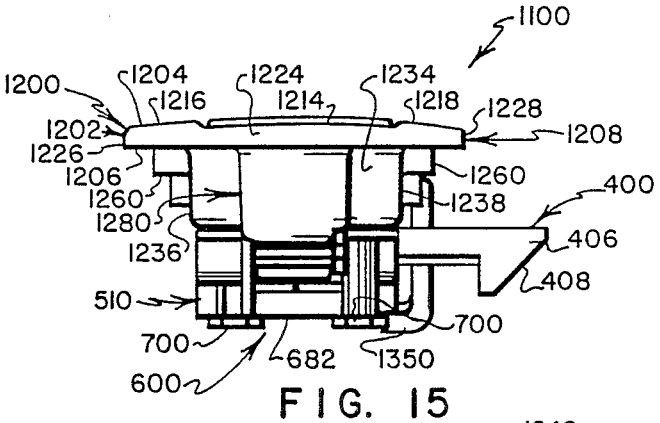
FIG. 15 is a bottom plan view thereof.
Figure 18:
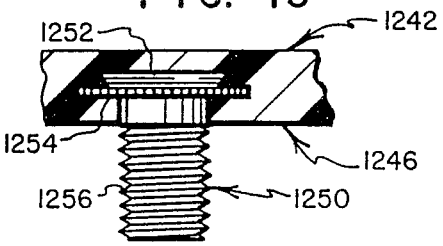
FIG. 18 is a sectional view as seen from a plane indicated by a line 18—18 in FIG. 12.
Figure 16:
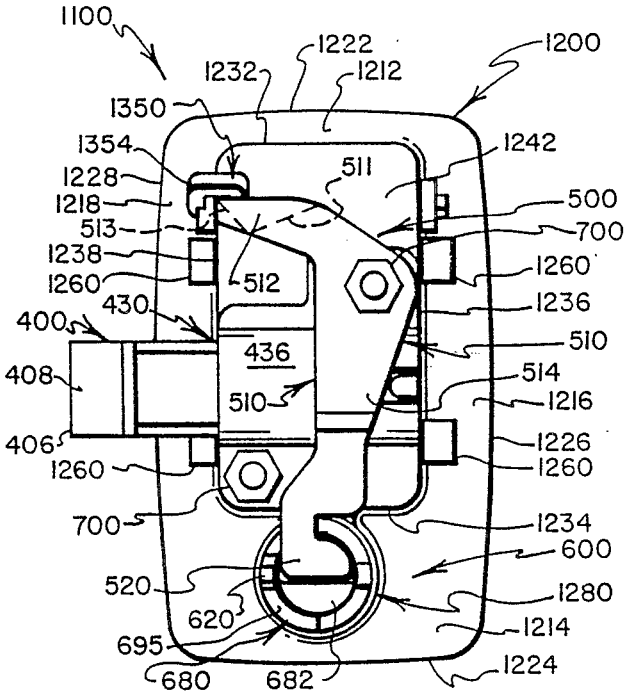
FIG. 16 is a rear elevational view similar to FIG. 14, but with the locking components unlocked.
Figure 17:
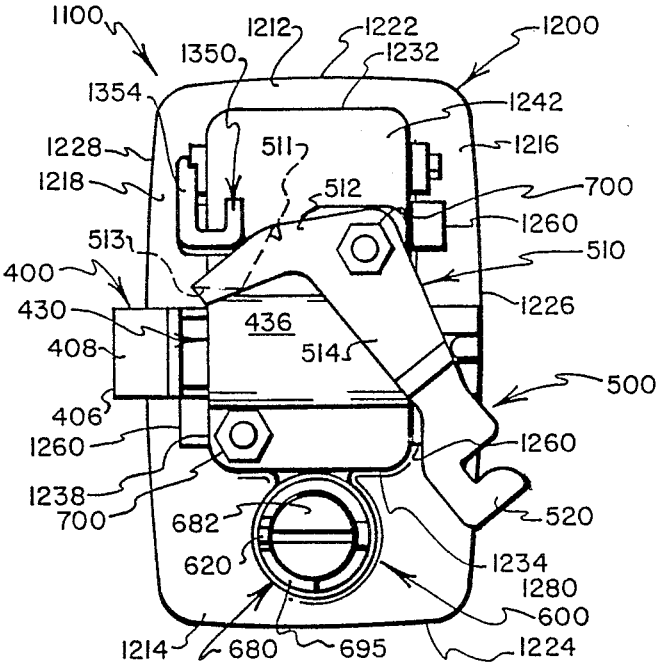
FIG. 17 is a rear elevational view similar to FIG. 16, but with the handle operated and with the latch bolt retracted to its unlatched position.
Figure 21:
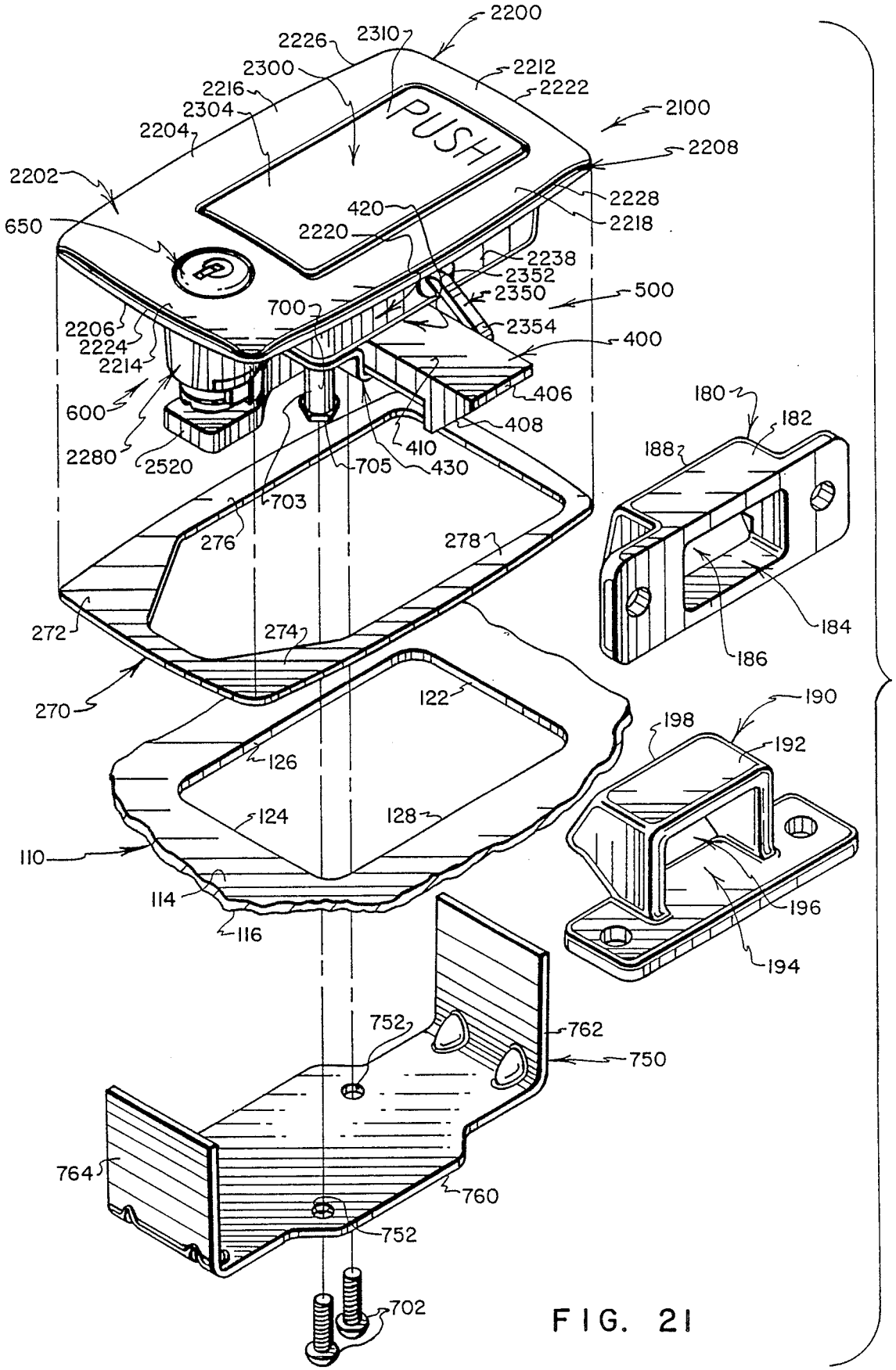
FIG. 21 is a perspective view of another form of lock that embodies feature of the preferred practice of the present invention illustrating how the lock assembly is mounted on a closure, and showing two types of strikers that may be used with the lock assembly.
Figure 22:
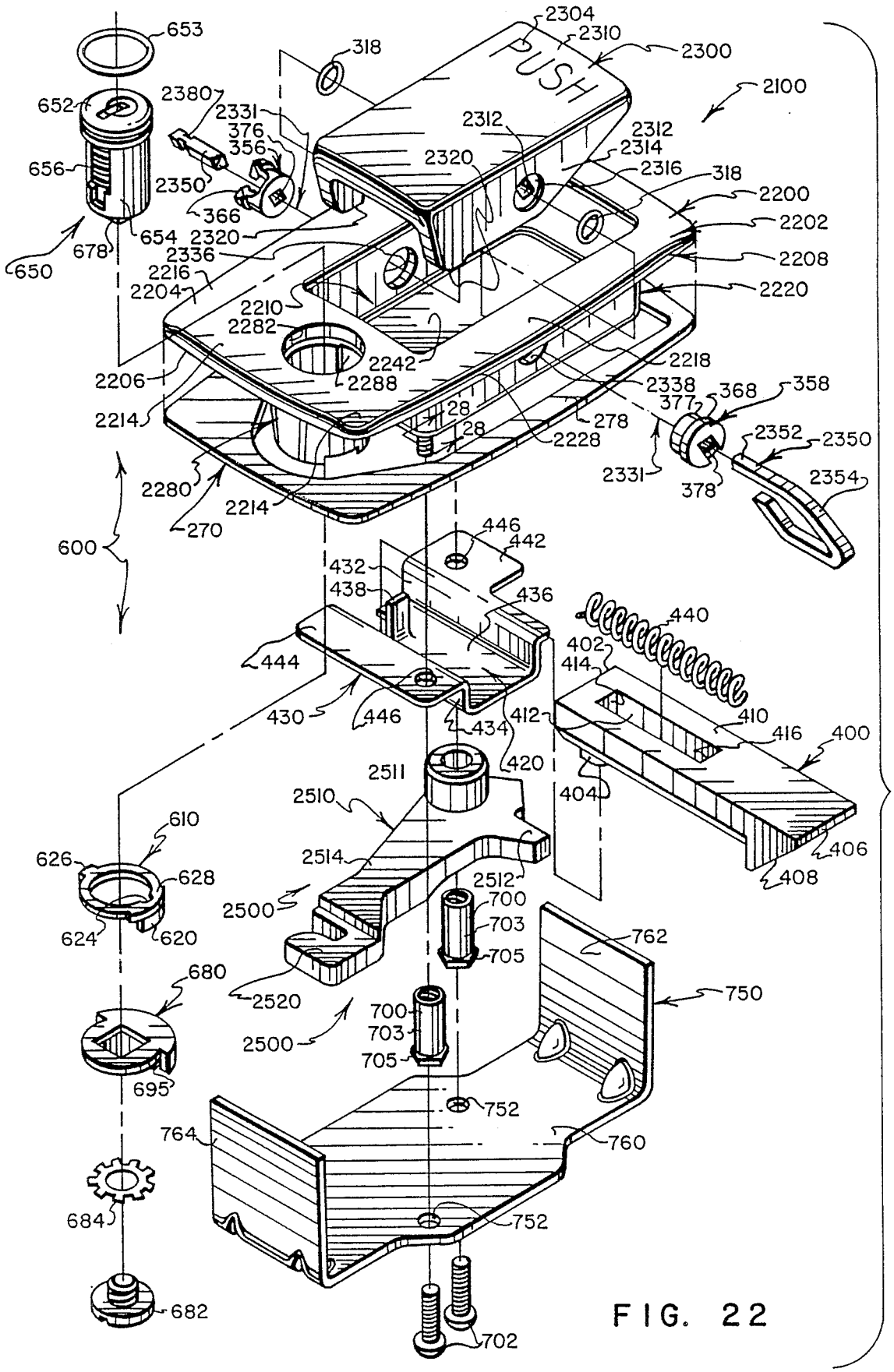
FIG. 22 is an exploded perspective view of components of the lock assembly of FIG. 21.
Figure 23:
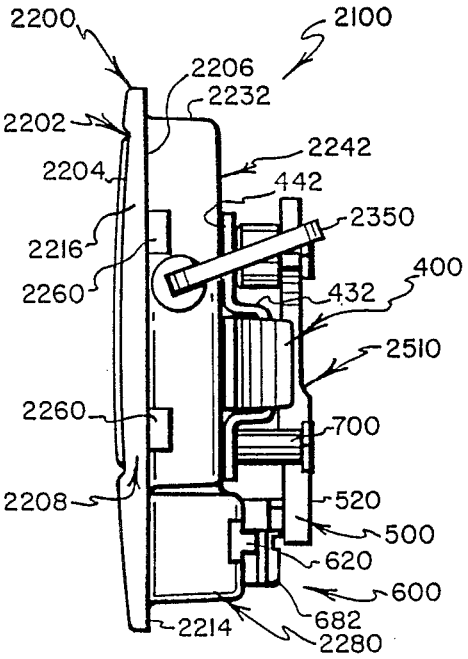
FIG. 23 is a right side elevational view thereof, with the handle in its normally nested position, with the latch bolt projected to its latched position, and with locking components locked.
Figure 24:
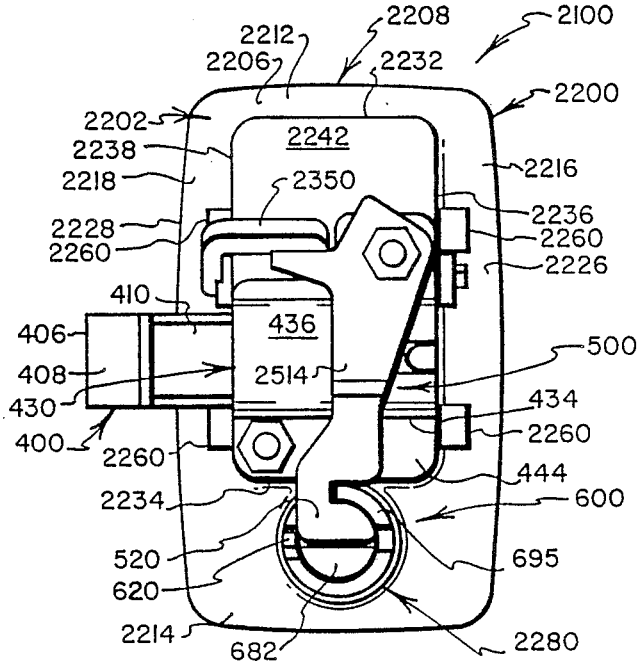
FIG. 24 is a rear elevational view thereof.
Figure 25:
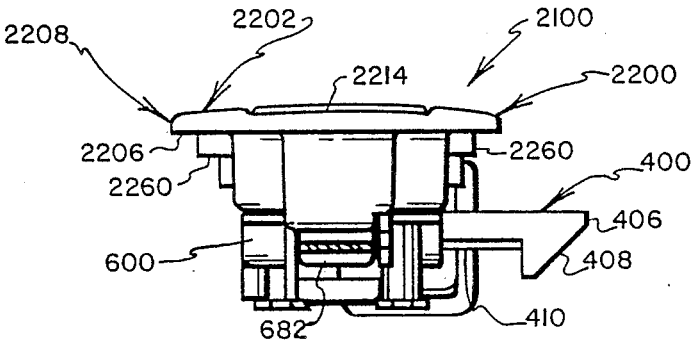
FIG. 25 is a bottom plan view thereof.
Figure 28:
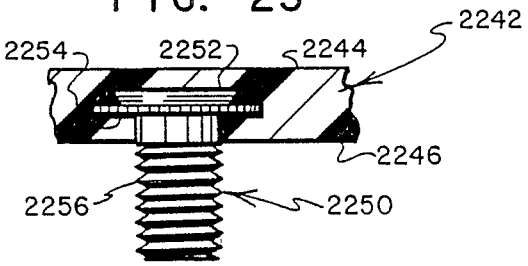
FIG. 28 is a sectional view as seen from a plane indicated by a line 28—28 in FIG. 22.
Figure 26:
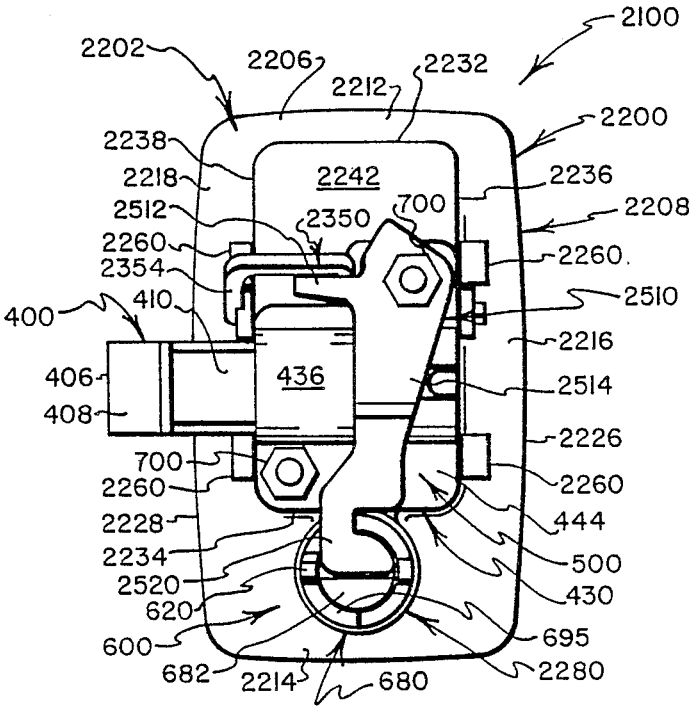
FIG. 26 is a rear elevational view similar to FIG. 24, but with the locking components unlocked.
Figure 27:
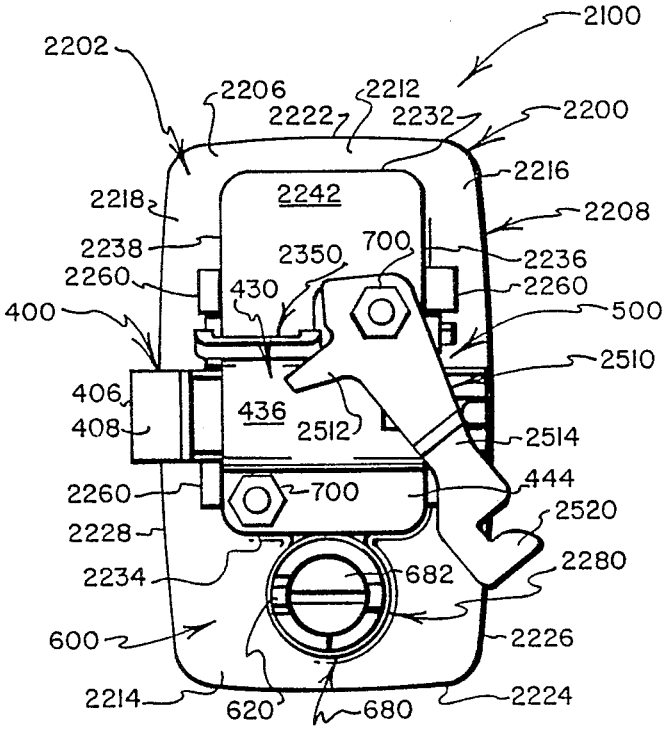
FIG. 27 is a rear elevational view similar to FIG. 26, but with the handle operated and with the latch bolt retracted to its unlatched position.

Referring to FIGS. 2, 12, and 22, aligned handle mounting holes 336, 338; 1336, 1338; and 2336, 2338 are formed through the side walls 236, 238; 1236, 1238; and 2236, 2238 on opposite sides of the recesses 210, 1210, 2210. The holes 336, 338; 1336, 1338; and 2336, 2338 are concentric about imaginary axes 331, 1331, 2331 that extend substantially parallel to the back walls 242, 1242, 2242 and that extend substantially perpendicular to the side walls 236, 238; 1236, 1238; and 2236, 2238.

The holes 336, 338; 1336, 1338; and 2336, 2338 are of equal diameters, and serve to journal reduced diameter end regions 346, 348 of a pair of bushings 356, 358. The bushings 356, 358 have relatively large diameter portions 366, 368 that extend alongside outer surfaces of the side walls 236, 238; 1236, 1238; and 2236, 2238. The O-rings 318 are positioned on the inside of the recess 316, 1316, 2316 to surround the holes 386, 338, 1236, 1238, 2236, 2238 to provide moisture seals that are compressed between opposite sides of the handle 300, 1300, 2300 and inner surfaces of the housing walls 236, 238; 1236, 1238; and 2236, 2238.

The bushings 356, 358 have square holes 376, 378 formed therethrough that extend along the imaginary axes 331, 1331, 2331. The hole 378 that is formed in the bushing 358 has an end region 379 that is widened to receive a corner bend of a handle mounting shaft 350, as will be explained. The hole 376 that is formed in the bushing 356 is narrowed on opposite sides as by inwardly extending projections that are designated by the numeral 377. The purpose of providing the projections 377 is to lock the bushing 356 in place on an associated one of the handle mountings shafts 350, 1350, 2350 that extend through the square hole 376, as will be explained.

The handle mounting shafts 350, 1350, 2350 are formed from stainless steel stock of square cross section, and are provided with leg portions 352, 354; 1352, 1354; and 2352, 2354 that are connected by curved, right-angle bends 356, 1356, 2356, respectively. The legs 352, 1352, 1354, extend through the bushing holes 376, 378 and the handle passages 312, 1312, 2312. Grooves 380, 1380, 2380 are formed in opposite sides of end regions 382, 1382, 2382 of the leg 352, 1352, 2352, respectively, to receive the bushing projections 377.

With respect to each of the lock assemblies 100, 1100, 2100, 3100, its latch bolt 400 is mounted on an associated one of the housings 200, 1200, 2200, 3200 for movement between a latched position that is extended (i.e., projected) with respect to its associated housing, as is shown in FIGS. 1, 11, 21 and 31, and an unlatched position that is withdrawn (i.e., retracted) with respect to the housing 200, as is shown in FIGS. 7, 17, 27 and 37. The latch bolt 400 is an elongate member of generally rectangular configuration having a left end region 402 that carries a rearwardly extending projection 404, and an enlarged right end region 406 that defines an inclined striker engaging surface 408. The latch bolt 400 also has an elongate central region 410 that interconnects and extends between the end regions 402, 406. An elongate slot 412 is formed in the central region 410. The slot 412 has a left end wall 414 and a right end wall 416.

The central region 410 is slidably received in a slide channel 420 that extends horizontally across the back wall 242 of the housing 200. The slide channel 420 is of generally rectangular cross-section and is cooperatively defined by the back wall surface 246 and by a stamped stainless steel bracket 430 that is mounted on one of the housings 200, 1200, 2200, 3200 in engagement with the rear face 246, 1246, 2246, 3246 of the back wall 242, 1242, 2242, 3242. The stamped sheet metal bracket 430 has opposed top and bottom walls 432, 434 that define opposed sides of the slide channel 420, and a back wall 436 that cooperates with the rear face 246 of the back walls 242, 1242, 2242, 3242 to define the back and front of the horizontally extending slide bolt channel 420, respectively.

The bracket 430 has upper and lower mounting flanges 442, 444 that border the top and bottom walls, 432, 434, respectively. The flanges 442, 444 have mounting holes 446 formed therethrough to receive the threaded mounting studs 250. The back wall 436 has a forwardly extending tab 438 that projects into the slide bolt channel 420 and into the slot 412 that is formed in the latch bolt 400.

A compression coil spring 440 is carried in the slot 412. The spring 440 has opposed ends that engage the tab 438 and the right end wall 416 of the slot 412, respectively, to bias the latch bolt 400 toward its projected or "latched" position. When the latch bolt 400 is in its latched position, the tab 438 engages the left end wall 414 of the slot 412.

The operating linkages 500, 2500 include L-shaped operating arms 510, 2510 that are pivotally mounted on the housings 200, 1200, 2200 and 3200, respectively, by one of the mounting posts 700. The mounting posts 700 have cylindrical portions 703 that are threaded onto the studs 250 and that extend through holes 511, 2511 that are formed in the arms 510, 2510. The mounting posts have enlarged hex formations 705 that retain the arms 510, 2510 in place on the cylindrical portions 703, and that can be engaged by a nut driver or a wrench to tighten the mounting posts 700 in place on the studs 250.

Because the lock assembly 3100 has an operator graspable handle 3300 that slides within the recess 3210 rather than pivots relative to its associated housing 3200 (as is the case with the handles of the lock assembles 100, 1100 and 2100), a brief discussion is in order concerning the unique character of this sliding handle embodiment.

Referring to FIGS. 31–39 wherein features of the lock assembly 3100 are depicted, two operator engageable structure 3900, 3910 are nested in the recess 3210. The structures 3900, 3910 are identical in many essential respects, with one principal difference residing in the fact that the structure 3900 is rigidly bonded to the housing formation that surround the recess 3210, while the structure 3910 is a handle that is movable relative to the housing 3200 along the length of the recess 3210. A slot 3912 (shown in phantom in FIG. 32 and depicted in part in FIG. 39) is formed through the housing back wall 3242 to receive a handle carried arm or projection 3350 that extends through the slot 3912 for engaging the operating arm 3510 to move the arm 3510 to unlatch the lock or latch 3100.

Figure 39:
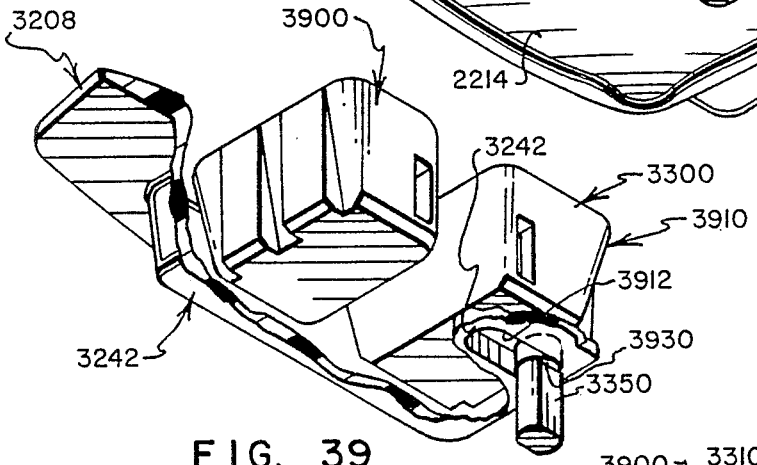
FIG. 39 is a perspective view of selected portions of the handle and the housing of the lock assembly of FIGS. 31–37, with the view showing principally rear portions of the handle, and with portions of the housing broken away.

As is best seen in FIG. 39, the handle operated arm or projection 3350 has a shoulder 3930 formed thereon at a location spaced slightly below the opening in the back wall 3242 so that, when a guide member 3940 is installed on the projection 3350 in a press-fit, the guide member 3940 will rest against the shoulder 3930 and not clamp against the back wall 3242 in away that will inhibit movement of the handle relative to the housing 3200. Preferably, the connection between the handle projection 3350 and the guide member 3940 is secured as by adhesive bonding, whereby the handle operated arm 3350 is every bit as suited as the handle operated arms 350, 1350, 2350 to pivot the arms 510, 2510 in response to handle movement.

The operating arms 510, 2510 have leg portions 512, 2512 of that are engaged by the handle operated arms 350, 1350, 2350, 3350 and that are caused to pivot about an associated one of the mounting posts 700 in response to movement of an associated handle 300, 1300, 2300, 3300 from its normal or nested position to its operating position.

Referring to FIGS. 2 and 12, the leg 512 of the arm 510 features a forwardly extending projection 511 that provides a stop surface 513. The stop surface 513 is configured to engage the top side wall 432 of the latch bolt housing 430 when the operating arm 510 is in the position shown in FIGS. 7 and 17, wherein the arm 510 functions to fully retract the latch bolt 400. A further feature of the configuration of the arm 510 is that the stop surface 513 is arranged to engage the latch housing wall 432 at the same time that the handle stop projections 320, 1320 engage the housing back walls 242 1242 so that further movement of the handles 300, 1300 and of the arms 510 is positively prevented.

The arms 350, 1350, 2350, 3350 also have leg portions 514, 2514 that overlie the housing back walls 242, 1242, 2242, 3242, that engage the bolt projections 404, and that have hook shaped end regions 520, 2520 that overlie portions of the housing sleeve formations 280, 1280, 2280, 3280. As will be explained, the lock mechanisms 600 serve to engage the hook shaped end regions 520, 2520 to selectively permit and prevent movement of the arms 510, 2510 in response to attempted operation of the handles 300, 1300, 2300, 3300.

The lock mechanisms 600 include a ring-like insert 610 that is provided for positioning in the rear end regions 292, 1292, 2292, 3292 of the sleeve portions 280, 1280, 2280, 3280 of the housings 200, 1200, 2200, 3200. The insert 610 serves the function of closing rear end regions of the top and bottom grooves 288, 1288, 2288, 3288, and of defining a rearwardly extending stop projection 620 for limiting the range of rotary movement of locking members 630.

In order to provide an extension of the rounded installation groove 294, 1294, 2294, 3294 through the ring-like insert 610, a rounded groove 624 is formed in the insert 610 and is aligned with the rounded grooves 294, 1294, 2294, 3294 of the sleeve members 280, 1280, 2280, 3280. In order to properly position the ring-like insert 610 for mounting on the housings 200, 1200, 2200, 3200, a pair of radially extending formations 626, 628 are provided to engage the grooves 296, 298; 1296, 1298; 2296, 2298; and 3296, 3298 that are formed at the rear end of the sleeve members 280, 1280, 2280, 3280. The groove 626 and the formations 296, 1296, 2296, 3296 are of relatively small size and are configured to mate in a close slip fit. The groove 628 and the formations 298, 1298, 2298, 3298 are of relatively larger size and are configured to mate in a close slip fit.

Referring to FIGS. 2, 12, 22, 32, a key-receiving, tumbler-carrying plug assembly 650 is provided that has an enlarged diameter head portion 652 that has a circumferentially extending groove for carrying an O-ring 653, and a smaller diameter body 654 that is configured to be rotatably received in the openings and passages 282, 284; 1282, 1284; 2282, 2284; and 3282, 3284, respectively. Radially extensible tumblers 656 form components of the plug 650 assembly and are extensible into the top and bottom grooves 288, 1288, 2288, 3288 to selectively permit and prevent rotation of the key cylinder assembly 650 with respect to the housings 200, 1200, 2200, 3200.

The key cylinder assembly 650 has a rearwardly projecting square drive formation 678 that is engaged by a rotary locking member 680. The rotary locking member 680 is rigidly attached to the cylinder assembly by means of a threaded fastener 682 and a lock washer 684.

The locking member 680 has a rearwardly extending projection 695 of curved shape that can be rotated by the key cylinder assembly 650 into and out of locking engagement with the hook shaped end regions 520, 2520 of associated ones of the arms 510, 2510. The rearwardly extending projection 620 of the insert ring 610 limits the range of rotary travel of the locking member 680 so as to prevent full 360 degree rotation thereof. The rearwardly extending projection 695 of the locking member 680 is rotatable (1) into locking engagement with the hook shaped end regions 520, 2520 of the operating arms 510, 2510, and (2) out of locking engagement therewith to permit pivotal movement of the arms 510, 2510 by the handles 300, 1300, 2300, 3300 to retract (i.e., "unlatch") the latch bolt 400.

A locked orientation of the locking mechanism components as described above is presented in an exploded display in FIG. 41 and is designated by the numeral 790. An unlocked orientation of these components is designated by the numeral 792.

If desired, the key locking cylinder assembly 650 can be replaced by tool operated plugs, as designated by numerals 800, 810 in FIG. 41. Detent devices 802, 812 are preferably provided in the plugs 800, 810 as by forming radially extending bores 804, 814 that house springs 806, 816 and balls 808, 818 which cooperate with such interior sleeve formations as the grooves 788 that are shown in FIG. 41 to releasably retain the plugs 800, 810 in position to prevent undesired rotation thereof.

The plugs 800, 810 carry tool receiving formations, typically a hex 820 recess for receiving an Allen wrench, or a narrow, shallow slot 822 for receiving a screwdriver.

Operation of the locks 100, 1100, 2100, 3100 described herein to retract their slide bolts 400 will be understood by those skilled in the art to involve a simple movement of their operating handles 300, 1300, 2300, 3300 when their locking mechanisms 600 are unlocked, whereby their operating arms 510, 2510 will pivot to effect latch bolt retraction. And, because latch bolt movement is not directly tied to operating arm movement, the described locks and latches have a "slam" capability that enables the latch bolts 400 to be moved into latching engagement with strikers 180, 190 without causing corresponding handle movements.

To the extent that orientation terms such as "frontwardly," "rearwardly," "upwardly," "downwardly" and the like have been used in this document, it will be understood that such terms have been used simply for convenience and to facilitate understanding of the features that have been described, whereby the use of such orientation term should not be deemed to limit the scope of the claims that follow.

Although the invention has been described in its preferred form with a certain degree of particularity, it will be understood that the present disclosure of the preferred form has been made only by way of example, and that numerous changes in the details of construction and the combination and arrangements of parts and the like may be resorted to without departing from the spirit and scope of the invention as hereinafter claimed. It is intended that the patent shall cover, by suitable expression in the appended claims, whatever features of patentable novelty exist in the invention disclosed.

What is claimed is:

1. A flush-mountable latch, comprising:

(a) housing means including a pan-shaped housing having a front wall, and having recess-defining wall formations that define a forwardly facing recess, with portions of the front wall forming a mounting flange that surrounds the recess;

(b) the housing being formed as a rigid, one-piece molded structure, with the recess-defining wall formations including a back wall at the rear of the recess, and with the back wall defining a rearwardly facing mounting surface;

(c) fastener means rigidly connected to the back wall, including first and second fastener members that are rigidly connected to the back wall at first and second spaced locations near opposite sides of the mounting surface;

(d) handle means including a handle that resides in the recess, that is connected to the housing, and that is movable relative to the housing between a non-operated position and an operated position;

(e) opening means formed through the recess-defining wall formations of the housing to establish a path of communication between the forwardly facing recess and a region that is located behind the back wall;

(f) handle-connected means extending through the opening means for connection to the handle and having a portion that extends into said region located behind the back wall for being moved within said region in response to movement of the handle between its non-operated and operated positions;

(g) latch bolt means including an elongate latch bolt that engages and extends across the mounting surface along a path of travel that extends between the first and second locations where the first and second fastener members are rigidly connected to the back wall, with the length of the elongate latch bolt paralleling said path of travel, and with the latch bolt being slidably movable along said path of travel between latched and unlatched positions;

(h) latch bolt mounting plate means for extending along said path of travel and being configured to retain the latch bolt in engagement with the mounting surface during sliding movement of the latch bolt along said path of travel, including a mounting plate formed as a metal stamping that has first and second mounting flange portions that extend along opposite sides of said path of travel and are configured so as to engage the mounting surface on opposite sides of said path of travel, with the mounting plate also having guide formation means connected to the mounting flange portions and being configured to overlie said path of travel at locations behind the mounting surface so as to cooperate with the mounting surface of the back wall to define a slide channel that extends along said path of travel in surrounding relationship with portions of the elongate latch bolt for restricting movement of the latch bolt to a sliding type of movement within the slide channel along said path of travel;

(i) first and second openings formed through the first and second mounting flange portions, respectively, with the first opening being aligned with said first fastener member, and with the second opening being aligned with said second fastener member;

(j) first and second mounting means for rigidly connecting rigidly with the first and second fastener members, respectively, and for cooperating with the first and second fastener members to provide first and second retaining means for extending through the first and second openings and for engaging the first and second mounting flange portions to clamp the first and second mounting flange portions into engagement with the mounting surface, and to thereby rigidly mount the latch bolt mounting plate means on the back wall of the housing;

(k) operating means including an L-shaped operating arm that has a central portion and a pair of leg portions that extend in different directions from the central portion so as to give the operating arm a generally "L-shaped" configuration, with the central portion being pivotally connected to a selected one of the first and second retaining means for pivotal movement relative to the housing, with one of the leg portions interconnecting with the handle-connected means at a location within said region, and with the other of the leg portions interconnecting with the latch bolt means for effecting movement of the latch bolt means from its latched position to its unlatched position in response to movement of the handle from its non-operated position to its operated position, with the central portion and the leg portions of the L-shaped operating arm overlying portions of the back wall, and with said other of the leg portions extending transversely across said path of travel of the latch bolt.

2. The latch of claim 1 wherein the front wall has a front surface that extends in a smooth convex curve, with the thickness of the front wall portions that define the mounting flange differing across the front wall, with maximum thickness being provided where the front wall portions join with the recess-defining wall formations so as to form strong junctures between the front wall and the recess-defining wall formations all along the juncture of the recess-defining wall formation with the front wall.

3. The latch of claim 2 wherein the handle is formed as a rigid, one piece molded structure, the handle has a front wall that has a front surface, and the front surface of the handle is configured to extend contiguously with front surface portions of the housing when the handle is in its non-operated position.

4. The latch of claim 3 wherein the housing and the handle are formed from an injection molded, glass reinforced, polycarbonate based polymer blend thermoplastics material.

5. The latch of claim 1 wherein the latch bolt slide channel is open at both ends thereof, and the latch bolt is of sufficient length to provide first and second opposed end regions thereof that are capable of simultaneously extending beyond the length of the slide channel.

6. The latch of claim 5 wherein the latch bolt housing has an integrally formed tab portion that projects into the slide channel, and the latch bolt has an elongate slot formed therein that receives the tab of the latch bolt housing.

7. The latch of claim 6 additionally including a compression coil spring positioned in the elongate slot of the slide bolt with one end region of the coil spring engaging one end region of the elongate slot, and with the other end region of the compression coil spring engaging the tab of the latch bolt housing, whereby the compression coil spring operates to bias the latch bolt toward an extended, "latched" position with respect to the housing.

8. The latch of claim 1, wherein:

(a) the opening means includes at least one hole formed through recess-defining wall formations extend between the front and back walls; and, (b) the handle-connected means includes an elongate element that extends through the at least one hole, is journaled by the housing for pivotal movement relative thereto, and is rigidly connected to the handle for pivotally connecting the handle to the housing for movement between its non-operated and operated positions.

9. The latch of claim 8 wherein the handle has stop formation means thereon for defining the non-operated position of the handle as by engaging the back wall of the housing.

10. The latch of claim 1, wherein:

(a) the opening means includes an elongate slot that is formed in the back wall; and, (b) the handle-connected means includes a projection that extends rearwardly from the handle and through the elongate slot for engaging said one leg of the L-shaped operating arm to establish a driving connection between the handle and the operating arm.

11. The latch of claim 10 wherein the handle is slidably mounted on the housing, and retaining means is provided for connection with the rearwardly extending projection at a location behind the back wall to retain the handle nested within the recess.

12. The latch of claim 1 wherein the first and second mounting means, and the first and second fastener members are provided with thread formations for threadedly interconnecting the first and second mounting means with the first and second fastener members, respectively.

13. A flush mountable latch comprising:

(a) a pan-shaped housing having a front wall;

(b) the housing further including wall means connected to the front wall and defining a rearwardly extending recess that opens forwardly through the front wall, with portions of the front wall extending perimetrically about the recess for defining a mounting flange, and with portions of the wall means defining a back wall having a rearwardly facing mounting surface;

(c) handle means including a handle that is connected to the housing for movement relative thereto between non-operating and operating positions, with the handle being nested within the forwardly facing recess when the handle is in its non-operating position;

(d) hole means including at least one hole formed through the wall means that define the forwardly-facing recess;

(e) handle-connected means extending through said hole means for connection to the handle means and being responsive to movements of the handle means between its non-operating and operating positions to effect movement of a portion of the handle connection means at a location behind the back wall of the housing;

(f) latch bolt mounting bracket means engaging the back wall of the housing and cooperating therewith to define a slide channel that extends across the mounting surface along a path of travel;

(g) latch bolt means positioned in the slide channel and being movable along said path of travel between latched and unlatched positions;

(h) first and second mounting post means connected to the housing at first and second locations near opposite sides of the mounting surface and on opposed sides of said path of travel for clamping the latch bolt mounting bracket means into rigid engagement with the back wall; and, (i) operating means including an L-shaped operating arm that has a central portion and a pair of leg portions that extend in different directions from the central portion so as to give the operating arm a generally "L-shaped" configuration, with the central portion being pivotally connected to a selected one of the first and second mounting post means for pivotal movement relative to the housing, with one of the leg portions interconnecting with the handle-connected means at a location within said region, and with the other of the leg portions interconnecting with the latch bolt means for effecting movement of the latch bolt means from its latched position to its unlatched position in response to movement of the handle from its non-operating position to its operating position, with the central portion and the leg portions of the L-shaped operating arm overlying portions of the back wall, and with said other of the leg portions extending transversely across said path of travel of the latch bolt.

14. The latch of claim 13 wherein the latch bolt mounting bracket and the back wall cooperate to define said slide channel as being of generally rectangular cross section, and the latch bolt has a generally rectangular cross section that is received in a slip fit within the slide channel, with the latch bolt being of elongate character and having at least one end region that projects beyond an end of the slide channel for engagement with a suitably configured striker or other latch retaining formation.

15. The latch of claim 14 wherein:

(a) a notch is formed in the latch bolt mounting bracket near one end region of the slide channel; and, (b) the other end of the latch bolt has a rearwardly extending projection that is engageable with the notch and projects rearwardly beyond the latch bolt mounting bracket to a position of engagement with said one leg of the L-shaped operating arm.

16. The latch of claim 15 wherein:

(a) the notch that is formed in the latch bolt mounting bracket is formed by bending a tab-like piece of material of the bracket so that the tab-like portion extends into the slide channel;

(b) an elongate slot is formed in the body of the latch bolt;

(c) the tab portion extends into the elongate slot; and, (d) a compression coil spring is installed in the latch bolt slot at a location between the tab portion and one end region of the slot to bias the latch bolt toward its latched position.

17. The latch of claim 13 wherein the handle-connected means includes an elongate element that extends through the at least one hole that is formed through wall portions of the housing, is journaled by the housing for pivotal movement relative thereto, and is rigidly connected to the handle for pivotally connecting the handle to the housing for movement between its non-operating and operating positions.

18. The latch of claim 17 wherein a stop formation is provided on the pivotally mounted handle for engaging the recess defining wall means when the handle is in its operating position.

19. The latch of claim 18 wherein the L-shaped operating arm has a stop formation thereon that is configured to engage the latch bolt mounting bracket when the L-shaped operating arm is positioned by the elongate element due to the handle being positioned in its operating position, whereby the dual engagement of the handle-carried stop formation with the recess defining wall means, and the stop projection of the L-shaped operating arm with the latch bolt mounting bracket prevent unwanted movement of the handle.

20. The latch of claim 13 wherein the handle is slidably mounted on the housing, the hole means includes an elongate slot through which a projection that is formed on the handle means extends to define the handle-connected means, and the L-shaped operating arm engages the projection to effect movement of the latch bolt in response to movement of the handle.

21. The latch of claim 13 wherein the L-shaped operating arm has a hook-shaped end region that overlies a cylindrical sleeve formation carried by the housing, and a plug is rotatably mounted in the sleeve has a rearwardly-extending, curved projection that is configured to engage and to be received within the hook-shaped end region of the L-shaped operating arm to lock the L-shaped operating arm against pivotal movement relative to the housing.

22. The latch of claim 21 wherein the curved projection that extends rearwardly from the plug and the hook-shaped end region of the operating arm are configured such that attempted operation of the handle will apply torque to the operating arm in a direction that tends to cause the operating arm to hook more firmly into the curved projection so as to maintain locked interengagement of the projection with the hook-shaped end region.

23. The latch of claim 17 wherein the at least one hole includes a pair of aligned holes formed through wall means that define opposed sides of the recess, the elongate element includes a mounting shaft of substantially square section that extends through the bushings and through a square hole formed through the handle to mount the handle and the bushings for concurrent rotation about the axis of the shaft relative to the housing.

24. The latch of claim 23 wherein one of the bushings has a cut out side portion that communicates with the square hole formed through the bushing, and the mounting shaft has a right angle bend formed therein that extends into the bushing cut out so that the handle mounting member can extend closely along a side wall of the housing in substantially the same plane as the is occupied by a large diameter end region of the bushing.

25. The latch of claim 13 wherein the handle is slidably mounted on the housing, the handle has a projection that extends through a slot formed in the housing back wall, and a retaining member is mounted on the rearwardly extending projection at a location behind the back wall to retain the handle in sliding engagement with the back wall.

26. The latch of claim 25 wherein the rearwardly extending projection has a shoulder formed thereon to join a relatively larger cross sectional portion of the projection that extends through the slot formed in the back wall with a relatively smaller cross sectional portion of the projection that extends rearwardly from the shoulder, whereby, the shoulder serves as a stop to position the retaining member when the retaining member is installed on the projection.

27. The latch of claim 13 wherein the compression coil spring is adequately strong in the force that it exerts in biasing the latch bolt toward its latched position that, the action of the spring is transmitted through the L-shaped operating arm and through the handle-connected means to the handle so that the handle is biased toward its non-operating position.

28. The latch of claim 27 wherein the handle has stop formation means thereon for defining the non-operating position of the handle as a position wherein the stop formation means engage the back wall of the housing.

29. A flush-mountable lock, comprising:

(a) a pan-shaped housing having walls that define a forwardly facing recess surrounded by a front wall that defines a mounting flange that has a front face and a rear face, with the housing also having a locking plug mounting location defined adjacent the recess by means of a generally sleeve-like structure which has a through passage that opens through the front face of the mounting flange;

(b) the housing being formed as a one-piece structure from injection molded plastics material, with the walls including a back wall at the rear of the forwardly facing recess, with the back wall closing the rear of the recess, and with the back wall defining a flat mounting surface on the back of the housing, with the housing additionally including first and second mounting studs each having an end portion embedded in the material of the back wall, with each of the mounting studs having a threaded portion that projects rearwardly from the back wall;

(c) handle means including a handle that resides in the recess, that is connected to the housing, and that is movable relative to the housing between a non-operated position and an operated position;

(d) an opening formed through a selected portion of the walls that define the forwardly facing recess;

(e) handle-connected means extending through the opening for connection to the handle and for being moved in response to movement of the handle between its non-operated and operated positions;

(f) latch bolt mounting bracket means engaging the back wall of the housing and cooperating therewith to define a slide channel that extends across the mounting surface along a path of travel;

(g) latch bolt means along a path of travel relative to the housing between latched and unlatched positions;

(h) first and second mounting post means connected to the housing at first and second locations near opposite sides of the mounting surface and on opposed sides of said path of travel for clamping the latch bolt mounting bracket means into rigid engagement with the back wall; and, (i) operating means including an L-shaped operating arm that has a central portion and a pair of leg portions that extend in different directions from the central portion so as to give the operating arm a generally "L-shaped" configuration, with the central portion being pivotally connected to a selected one of the first and second mounting post means for pivotal movement relative to the housing, with one of the leg portions interconnecting with the handle-connected means at a location within said region, and with the other of the leg portions interconnecting the latch bolt means for effecting movement of the latch bolt means for effecting movement of the latch bolt from its latched to its unlatched positions in response to movement of the handle from its non-operated position to its operated position, with the central portion and the leg portions of the L-shaped operating arm overlying portions of the back wall, and with said other of the leg portions extending transversely across the path of travel of the latch bolt.

30. The latch of claim 29 wherein the front wall has a front surface that extends in a smooth convex curve, with the thickness of the front wall portions that define the mounting flange differing across the front wall, with maximum thickness being provided where the front wall portions join with the recess-defining wall formations, so as to form strong junctures between the front wall and the recess-defining wall formations all along the juncture of the recess-defining wall formation with the front wall.

31. The latch of claim 30 wherein the handle is formed as a rigid, one piece molded structure, the handle has a front wall that has a front surface, and the front surface of the handle is configured to extend contiguously with front surface portions of the housing when the handle is in its non-operated position.

32. The latch of claim 31 wherein the housing and the handle are formed from an injection molded, glass reinforced, polycarbonate based polymer blend thermoplastics material.

33. The latch of claim 29 wherein the slide channel is open at both ends thereof, and the latch bolt is of sufficient length to provide first and second opposed end regions thereof that are capable of simultaneously extending beyond the length of the slide channel.

34. The latch of claim 33 wherein the latch bolt mounting bracket means has an integrally formed tab portion that projects into the slide channel, and the latch bolt has an elongate slot formed therein that receives the tab of the latch bolt mounting bracket means.

35. The latch of claim 34 additionally including a compression coil spring positioned in the elongate slot of the latch bolt with one end region of the coil spring engaging one end region of the elongate slot, and with the other end region of the compression coil spring engaging the tab of the latch bolt mounting bracket means, whereby the compression coil spring operates to bias the latch bolt toward an extended, "latched" position with respect to the housing.

36. A flush-mount lock for a closure, comprising:

(a) a one-piece housing having a front wall and having integrally-formed wall portions that join with the front wall to define a forwardly-facing recess that opens through the front wall, and with the front wall defining a mounting flange that extends perimetrically about the recess;

(b) the housing having a back wall with a front face that defines the rear of the recess, having a rear face that defines a substantially planar mounting surface, and having first and second mounting studs projecting rearwardly from the mounting surface;

(c) the housing being formed from injection-molded plastics material to provide a rigid structure, with the mounting studs being formed from metal and having enlarged head regions that embedded in the plastics material of the back wall;

(d) a latch bolt mounting plate having first and second spaced mounting portions engaging the rear surface of the back wall with first and second holes formed, respectively, through the first and second mounting portions, and with the first and second mounting studs extending through the first and second holes, respectively;

(e) the latch bolt mounting plate having wall portions that cooperate with the rear surface of the back wall to define a latch bolt slide channel that extends across the mounting surface along a path of travel that extends between the first and second mounting studs;

(f) an elongate latch bolt slidably carried in the latch bolt slide channel, the latch bolt slide channel being open at both ends thereof, and the latch bolt being of sufficient length to provide first and second opposed end regions thereof that are extensible simultaneously beyond both ends of the slide channel;

(g) the first end region of the latch bolt having a rearwardly extending engagement tab, and the second end region defining an enlarged end formation of such size as will prevent its entry into the slide bolt channel;

(h) the latch bolt mounting plate having an integrally formed tab portion that projects into the slide channel;

(i) the latch bolt having an elongate slot formed therein that receives the tab of the latch bolt mounting plate;

(j) a compression coil spring positioned in the elongate slot of the slide bolt with one end region of the coil spring engaging one end region of the elongate slot, and with the other end region of the compression coil spring engaging the tab of the latch bolt mounting plate, whereby the compression coil spring is operated to bias the latch bolt toward an extended, "latched" position with respect to the housing;

(k) first and second threaded mounting posts threaded onto the first and second studs for clamping the latch bolt mounting surface into firm engagement with the housing, and for defining a pair of spaced mounting formations for connection to a mounting bracket;

(l) a U-shaped mounting bracket having base wall means for overlying the rear surface of the back wall at a distance spaced rearwardly therefrom and having holes formed therein in alignment with the mounting posts for receiving threaded fasteners that connect the U-shaped mounting bracket to the mounting posts;

(m) an L-shaped operating arm pivotally connected to one of the mounting posts and having first and second leg portions that extend away from the location of the mounting post that pivotally mounts the operating arm, with the first and second leg portions overlying the back wall of the housing, with one of the leg portions extending substantially laterally across the mounting surface, and with the other of the leg portions extending transversely into engagement with the rearwardly projecting tab of the latch bolt;

(n) a handle positioned in the forwardly-facing recess;

(o) opening means formed in the pan-shaped wall structure that defines the recess; and, (p) mounting means movably mounting the handle on the housing and extending through the opening for engaging the one leg portions of the operating arm to drivingly connect the handle through the operating arm to the latch bolt for enabling the handle to pivot the operating arm about its mounting post to retract the latch bolt.

37. The lock of claim 36 wherein the other leg portion of the operating arm has a hooked-shaped formation, and a locking mechanism is provided having a curved formation that is movable into and out of engagement with the hook-shaped formation for selectively permitting and preventing movement of the operating arm to effect retraction of the latch bolt.

38. The lock of claim 36 wherein the handle is movable between a nested position and an operating position, and the handle has front face portions that extend substantially contiguously with the front face of the housing when the handle is in its nested position.

39. The lock of claim 38 wherein the handle has first and second stop formation means defined thereon for engaging wall portions that define the recess, with one of the stop formations effecting such engagement when the handle is in its nested position, and with the other of the stop formations effecting such engagement when its handle is in its operating position.

40. The lock of claim 39 wherein the handle has a square hole formation extending through portions of the handle that underlie the front face portions, and the mounting means includes a shaft of square cross section that is snugly fitted into the square hole of the handle for establishing a driving connection between the handle and the shaft, and wherein the shaft is pivotally connected to the housing to pivotally mount the handle on the housing for movement between its nested and operating positions.

41. The lock of claim 40 wherein a pair of aligned holes are formed through opposite side walls of the pan-shaped housing portion defines the recess wherein a pair of plastic bushing members having square holes bored therethrough are carried on the shaft and drivingly connected to the shaft for rotation therewith, with each bushing means being journaled in a separate one of the aligned holes for rotatably mounting the shaft on the housing.

42. The lock of claim 41 wherein a selected one of the bushing means and the shaft has recess means formed therein, and the other of the selected bushing means and the shaft has a projection formation thereon, and the projection formation extends into the recess formation for retaining the selected bushing means in position on the square shaft.

43. The lock of claim 41 wherein the square shaft is of L-shaped configuration having a first leg portion that extends through the bushings and through the aligned holes of the bushings, the handle and the housing, and the second leg portion extends alongside one of the side walls of the pan-shaped housing portion that defines the recess for engaging the one leg of the operating arm to drivingly interconnect the handle and the operating arm, and one of the bushings which is located in closest proximity to the junction of the first and second legs of the square shaft has an opening formed therethrough that is configured to receive the right angle juncture of the shaft that joins the first and second leg portions thereof.

44. The lock of claim 43 wherein the handle has an operator engagement formation located behind the front wall at a position that is within the recess when the handle is nested or being engaged by the hand of an operator to effect pivoting of the handle from its nested to its operating position as by moving the engagement formation of the handle forwardly to an extended position outside the confines of the recess.

45. The lock of claim 44 wherein the handle is configured such that its front wall extends from an end region of recess to a position substantially midway along the recess to thereby occupy at least about half of the recess where the recess opens through the front wall, with the handle being pivotally connected to the housing for movement relatively to the housing about an axis that is located in relatively close proximity to the one end region of the recess, and with the operator engagement formation being located on a back face of the handle at a location near the middle of the recess.

46. The lock of claim 43 wherein the handle has an operator engagement formation in the form of a hole in its front face, and the operator engagement formation is adjacent to the hole at a location near the middle of the recess when the handle is nested or being engaged by the hand of an operator to effect pivoting of the handle from its nested to its operating position as by moving the engagement formation of the handle forwardly to an extended position outside the confines of the recess.

47. The lock of claim 36 wherein the handle is pivotally mounted on the housing at a location about midway along the length of the elongate recess, the front face of the handle substantially fills the recess, and the handle is operated by pressing on one end region of the handle to pivot the handle one end region of the handle into the recess, with the opposite end region of the handle pivoted out of the recess.

48. The lock of claim 36 wherein the handle comprising a finger receiving compartment that is slidably carried within the recess for moving along the length of the recess between normal and operating positions.

49. The lock of claim 48 wherein an elongate slot is formed through the back wall of the housing at a location behind the slidably mounted handle, the slidably mounted handle has a rearwardly extending projection that extends through the opening for engagement with the one leg of the operating arm to effect pivoting of the operating arm to effect retraction of the latch bolt in response to movement of the handle between its normal and operating positions.

50. The lock of claim 49 wherein the rearwardly extending projection of the handle has a shoulder formation thereon at a location behind the rear surface of the back wall of the housing, with the shoulder formation providing a juncture between a relatively large cross-sectional portion of the projection that extends through the slot but is formed in the back wall, and a relatively smaller cross-sectional portion that projects rearwardly from the shoulder for engaging the one leg of the operating arm, and a retaining member is installed on the rearwardly extending projection and is positioned in engagement with the shoulder for retaining the handle in position on the housing by preventing retraction of the rearwardly extending projection of the handle through the slot that is formed in the back wall of the housing.

51. The lock of claim 50 wherein the retaining member has a hole formed therethrough, with the hole being sized to provide a press fit when the retaining member is installed on the rearwardly extending projection as by inserting the projection into the hole, and an adhesive is used to bond the retaining member to the rearwardly extending projection after the retaining member has been installed on the rearwardly extending projection in a position wherein the retaining member is in engagement with the shoulder.

52. The lock of claim 51 wherein the finger receiving formation defined by the handle is matched in configuration by another finger receiving formation that is formed on an axillary handle formation which is installed in the recess so as to be rigidly secured to the housing.

53. The lock of claim 36 wherein the other leg of the L-shaped operating arm has a hook-shaped formation that opens in a direction facing toward the path of movement that is followed by the hook-shaped formation in moving from a normal position to an operating position.

54. A flush-mount lock for a closure, comprising:

(a) a one-piece housing having a front wall and having integrally-formed wall portions that join with the front wall to define a forwardly-facing recess that opens through the front wall, and with the front wall defining a mounting flange that extends perimetrically about the recess;

(b) the housing having a back wall with a front face that defines the rear of the recess, and having a rear surface that is substantially planar and has a plurality of mounting studs projecting rearwardly from the rear surface;

(c) the housing being formed from injection-molded plastics material to provide a rigid structure, with the mounting studs being formed from metal and having enlarged head regions that embedded in the plastics material of the back wall;

(d) a latch bolt mounting plate having a plurality of spaced mounting portions engaging the rear surface of the back wall with holes formed through the mounting portions, and with the mounting portions arranged such that the mounting studs extend through the holes;

(e) the latch bolt mounting plate having wall portions that cooperate with the rear surface of the back wall to define a latch bolt slide channel that extends across the rear face of the back wall at locations between the mounting studs;

(f) an elongate latch bolt slidably carried in the latch bolt slide channel, the latch bolt slide channel being open at both ends thereof, and the latch bolt being of sufficient length to provide first and second opposed end regions thereof that are extensible simultaneously beyond both ends of the slide channel;

(g) the first end region of the latch bolt having a rearwardly extending engagement tab, and the second end region defining an enlarged end formation of such size as will prevent its entry into the slide bolt channel;

(h) the latch bolt housing having an integrally formed tab portion that projects into the slide channel;

(i) the latch bolt having an elongate slot formed therein that receives the tab of the latch bolt housing;

(j) a compression coil spring positioned in the elongate slot of the slide bolt with one end region of the coil spring engaging one end region of the elongate slot, and with the other end region of the compression coil spring engaging the tab of the latch bolt housing, whereby the compression coil spring is operated to bias the latch bolt toward an extended, "latched" position with respect to the housing;

(k) a pair of threaded mounting posts threaded onto the studs for clamping the latch bolt housing into firm engagement with the housing, and for defining a pair of spaced mounting formations for connection to a mounting bracket;

(l) a U-shaped mounting bracket having base wall means for overlying the rear surface of the back wall at a distance spaced rearwardly therefrom and having holes formed therein in alignment with the mounting posts receiving threaded fasteners that connect the mounting bracket to the mounting posts;

(m) an L-shaped operating arm pivotally connected to one of the mounting posts and having first and second leg portions that extend away from the location of the mounting post that pivotally mounts the operating arm and that overlie portions of the housing, with one of the legs extending substantially laterally across the rear surface of the back wall, and with the other of the legs extending into engagement with the rearwardly projecting tab of the latch bolt;

(n) a handle positioned in the forwardly-facing recess;

(o) opening means formed in the pan-shaped wall structure that defines the recess;

(p) mounting means movably mounting the handle on the housing and extending through the opening for engaging the one leg of the operating arm to drivingly connect the handle through the operating arm to the latch bolt for enabling the handle to pivot the operating arm about its mounting post to retract the latch bolt;

(q) the handle comprises a finger receiving compartment that is slidably carried with the recess for moving along the length of the recess between normal and operating positions;

(r) the elongate slot is formed through the back wall of the housing at a location behind the slidably mounted handle, the slidably mounted handle has a rearwardly extending projection that extends through the opening for engagement with the one leg of the operating arm to effect pivoting of the operating arm to effect retraction of the latch bolt in response to movement of the handle between its normal and operating positions;

(s) the rearwardly extending projection of the handle has a shoulder formation thereon at a location behind the rear surface of the back wall of the housing, with the shoulder formation providing a juncture between a relatively large cross-sectional portion of the projection that extends through the slot but is formed in the back wall, and a relatively smaller cross-sectional portion that projects rearwardly from the shoulder for engaging the one leg of the operating arm, and a retaining member is installed on the rearwardly extending projection and is positioned in engagement with the shoulder for retaining the handle in position on the housing by preventing retraction of the rearwardly extending projection of the handle through the slot that is formed in the back wall of the housing;

(t) the retaining member has a hole formed therethrough, with the hole being sized to provide a press fit when the retaining member is installed on the rearwardly extending projection as by inserting the projection into the hole, and an adhesive is used to bond the retaining member to the rearwardly extending projection after the retaining member has been installed on the rearwardly extending projection in a position wherein the retaining member is in engagement with the shoulder;

(u) the finger receiving formation defined by the handle is matched in configuration by another finger receiving formation that is formed on an auxiliary handle formation which is installed in the recess so as to be rigidly secured to the housing; and, (v) the auxiliary handle formation is rigidly connected to the housing by means of adhesive bonding.

* * * * *